US009200504B2

(12) United States Patent
Tunget

(10) Patent No.: US 9,200,504 B2
(45) Date of Patent: Dec. 1, 2015

(54) SPACE PROVISION SYSTEM USING COMPRESSION DEVICES FOR THE REALLOCATION OF RESOURCED TO NEW TECHNOLOGY, BROWNFIELD AND GREENFIELD DEVELOPMENTS

(76) Inventor: Bruce Tunget, Aberdeen (GB)

( * ) Notice: Subject to any disclaimer, the term of this patent is extended or adjusted under 35 U.S.C. 154(b) by 207 days.

(21) Appl. No.: 14/131,133

(22) PCT Filed: Jul. 5, 2012

(86) PCT No.: PCT/US2012/045626
§ 371 (c)(1),
(2), (4) Date: Jan. 6, 2014

(87) PCT Pub. No.: WO2013/006735
PCT Pub. Date: Jan. 10, 2013

(65) Prior Publication Data

US 2014/0123779 A1 May 8, 2014

(30) Foreign Application Priority Data

Jul. 5, 2011 (GB) ..... 1111482.4
Dec. 16, 2011 (GB) ..... 1121742.9

(51) Int. Cl.
*E21B 49/00* (2006.01)
*E21B 41/00* (2006.01)
*E21B 7/00* (2006.01)

(52) U.S. Cl.
CPC ..... *E21B 41/0035* (2013.01); *E21B 7/00* (2013.01)

(58) Field of Classification Search
None
See application file for complete search history.

(56) References Cited

U.S. PATENT DOCUMENTS

| | | | | |
|---|---|---|---|---|
| 5,117,685 | A | 6/1992 | Goldschild | |
| 6,148,664 | A | 11/2000 | Baird | |
| 2008/0066534 | A1 * | 3/2008 | Reid | E21B 49/06 73/152.11 |
| 2010/0126729 | A1 | 5/2010 | Tunget | |
| 2011/0000668 | A1 | 1/2011 | Tunget | |
| 2013/0292110 | A1 * | 11/2013 | Fraser | E21B 7/061 166/250.01 |
| 2013/0308753 | A1 * | 11/2013 | Groves | E21B 49/06 378/54 |
| 2015/0252621 | A1 * | 9/2015 | Tunget | E21B 4/003 175/61 |

* cited by examiner

*Primary Examiner* — Andre Allen

(57) ABSTRACT

System and method of well space provision for forming a geologic testing space for proving an operation of an unproven downhole apparatus (78, 92), generally referred to as new technology, within an aged geology, during the rigless abandonment of an aging well to, in use, reallocate operation of said unproven downhole apparatus from unproven to proven operation within a proximally similarly aged geology of said aging well, another aging well (79), a new well (80), or a field of said wells (79, 80) generally referred to as Brownfields and Greenfields, wherein said unproven downhole apparatus comprises a hydrodynamic bearing boring apparatus (1A, 1E, 1BM, 9AA, 92D) or a bore hole piston apparatus (1A, 1AF, 92A-92C, 92E-92G).

32 Claims, 6 Drawing Sheets

Fig.1
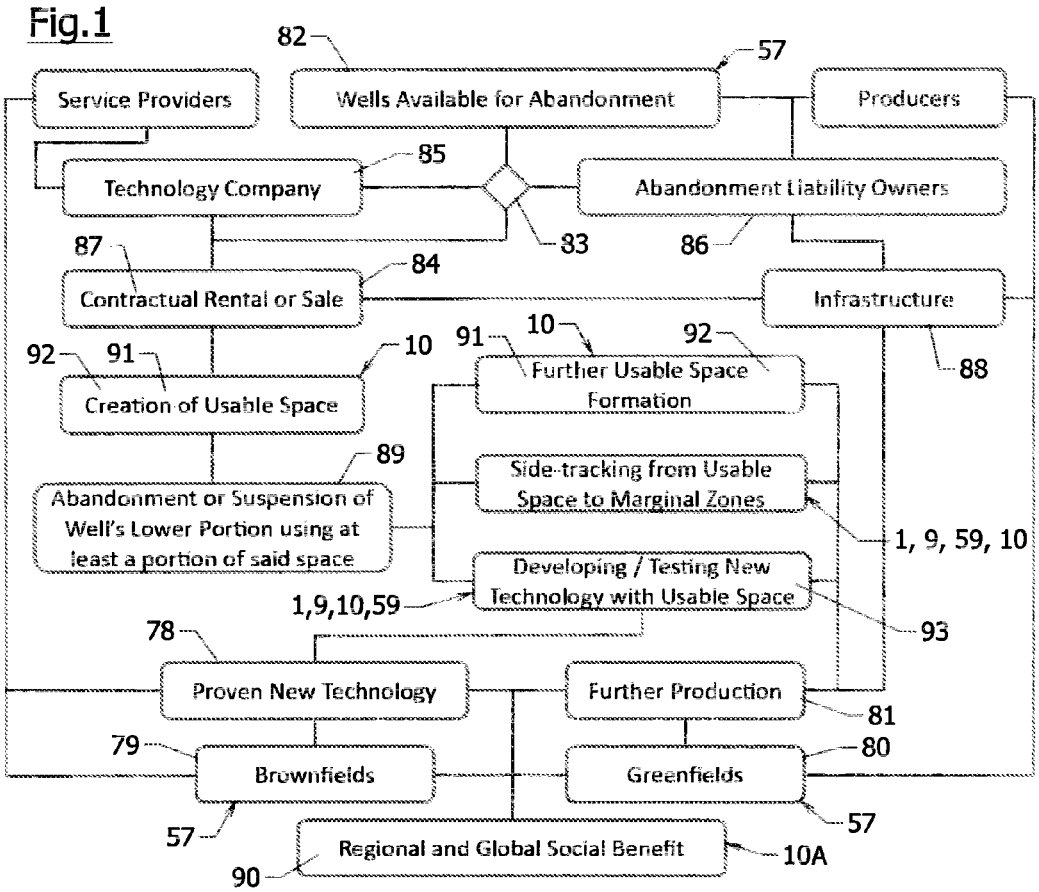
Fig.8
Prior Art
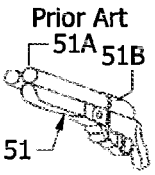
Fig.9
Prior Art
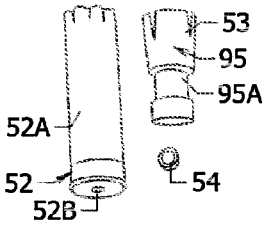
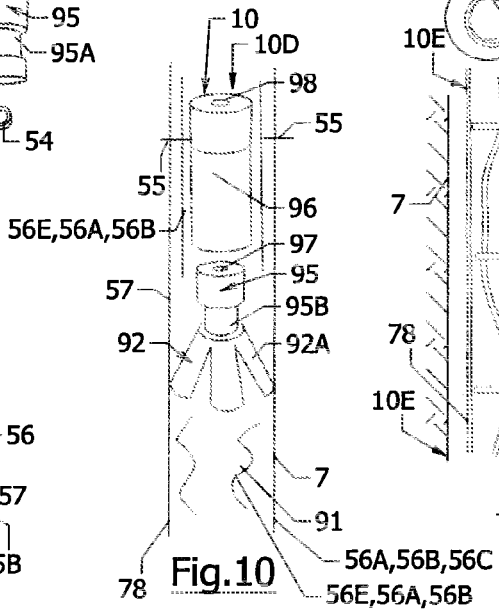
Fig.10
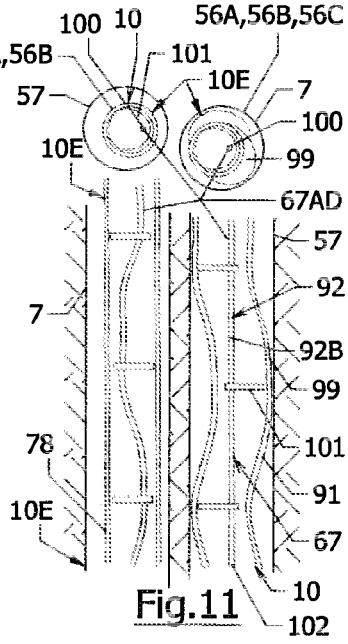
Fig.11
Fig.12
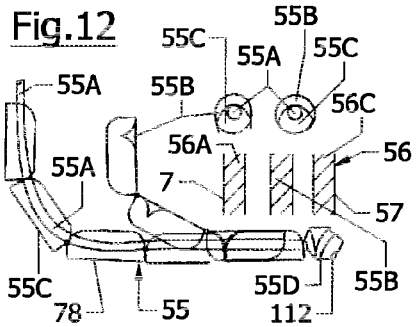

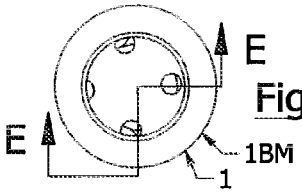
Fig.14
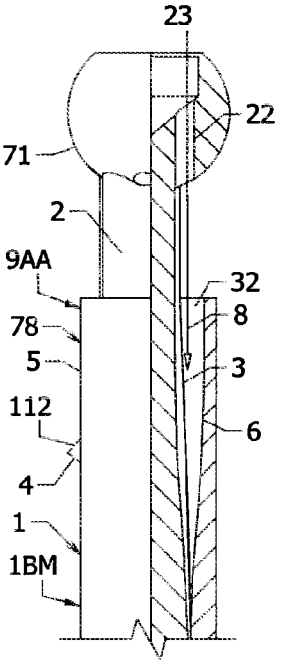
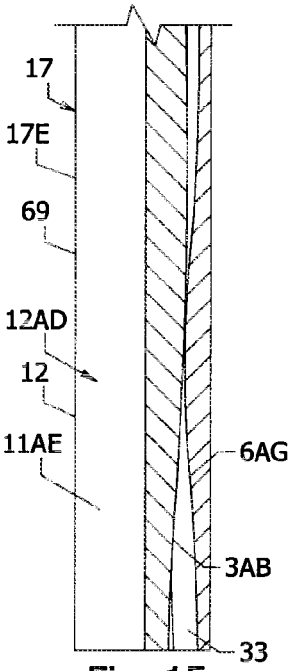
Fig. 15
Section E-E
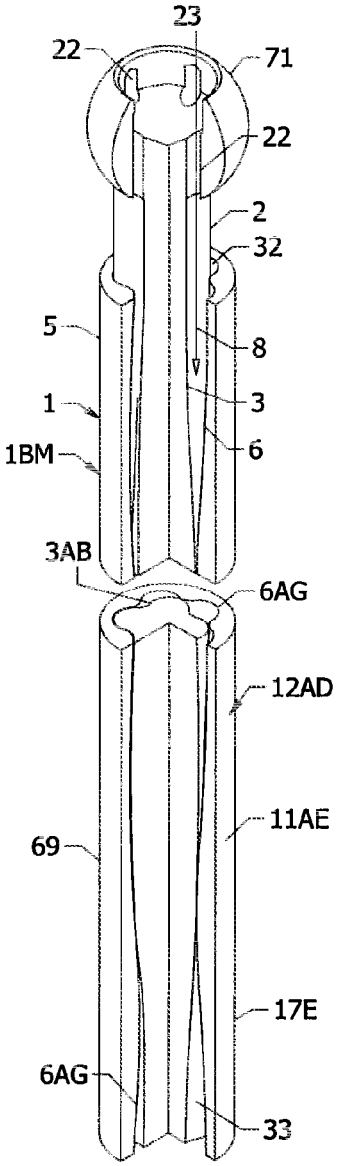
Fig.16
Fig.13
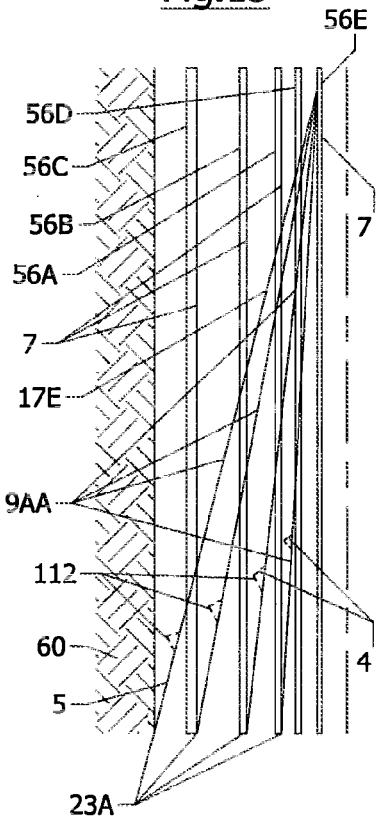
Fig.22
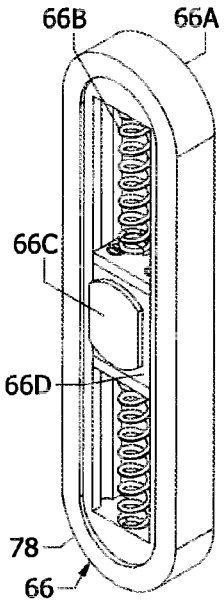

94
58
80
58A
72
67
72B
67E
125
124
56B
123
B
B
119
78
56A
78
56D
56D 94
126
67
67F
58
58C
127
79
56C
C
C
56B
56A
9
9C
67F
120
121
17
89
1
59C
1Q
17I
59
78
112

58
58D
67S
130
131
67
61
62
56C
56B
64
79
56A
56D
D
D
78
9
9H
17
1
17L
1U
73
73G 133
124
129
132
129
124
91
123

Fig.23
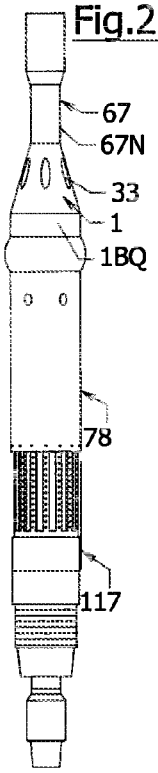
Fig.25
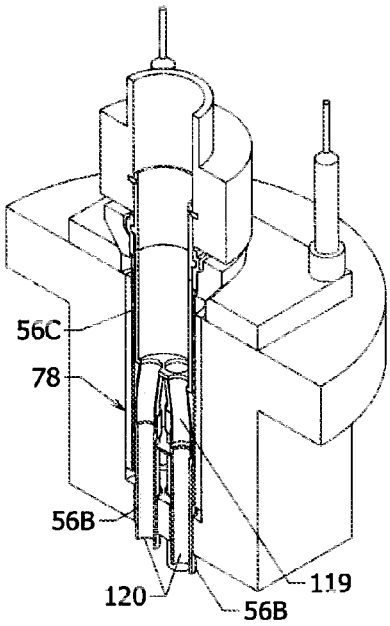
Fig.28
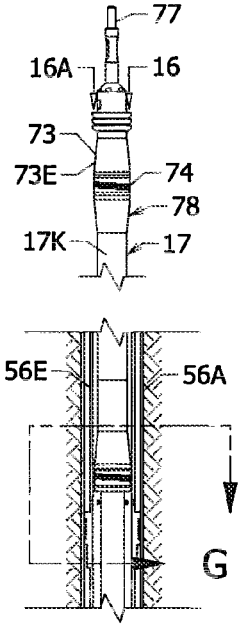
F Fig.26 F
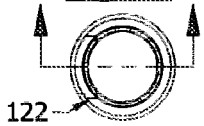
Fig. 27
SECTION F-F
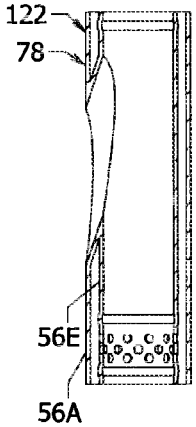
Fig.24
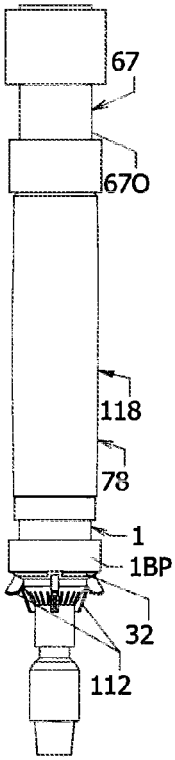
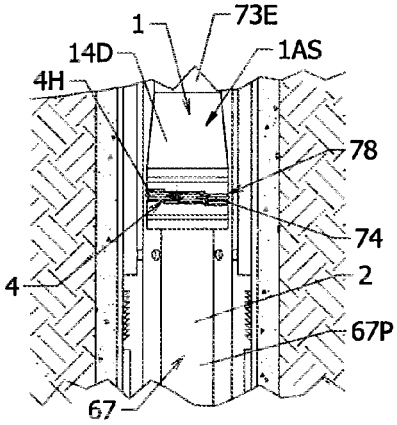
Fig. 29
DETAIL G
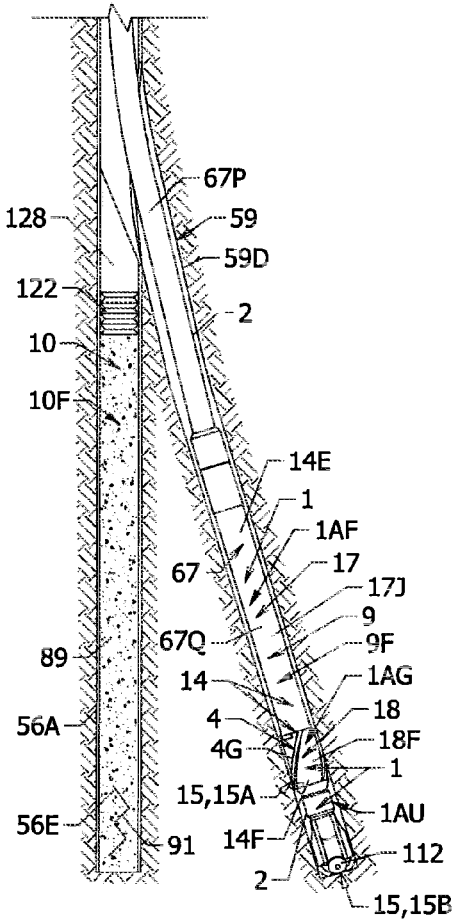

SPACE PROVISION SYSTEM USING COMPRESSION DEVICES FOR THE REALLOCATION OF RESOURCED TO NEW TECHNOLOGY, BROWNFIELD AND GREENFIELD DEVELOPMENTS

The present application claims priority to patent cooperation treaty (PCT) application having PCT Application Number PCT/US2012/045626, entitled "a Space Provision System Using Compression Devices For the Reallocation of Resources To New technology, Brownfield And Greenfield Developments," filed Jul. 5, 2012, which claims priority to United Kingdom Patent Application having Number GB1111482.4, entitled "Cable Compatible Rig-Less Operable Annuli Engagement System For Using And Abandoning A Subterranean Well", filed 5 July, 2011, and United Kingdom Patent Application having Number GB1121742.9, entitled "A Space Provision System Using Compression Devices For The Reallocation Of Resources To New Technology, Brownfield And Greenfield Developments", filed 16 Dec. 2011, all of which is incorporated herein in its entirety by reference.

FIELD

The present invention relates, generally, to systems and methods usable to form a geologic testing space within downhole conditions for proving the operation of an unproven downhole apparatus, within an aged geology and during the rig-less abandonment of an aging well, and for reallocating the operation of said unproven downhole apparatus, from an unproven to a proven state, which can occur in an environment with lower failure consequences to, in use, provide new technology that is proven across relevant geologic periods and epochs of practice.

BACKGROUND

The present invention relates, generally, to apparatus and methods usable for rig-less abandonment and the forming of a geologic testing space that can be usable to reallocate the use of, for example, drilling rigs, for performing well abandonments and testing or proving new technology to other uses, including using the proven technology with said drilling rigs for the further development of Brownfield and Greenfield subterranean deposits. Various new technologies, which can be usable, testable and provable during rig-less abandonment, include the new technologies discussed in prior applications of the present inventor, for example: UK Patent 2465478, entitled "Apparatus And Methods For Operating A Plurality Of Wells Through A Single Bore"; United Kingdom Patent Application having Number GB1011290.2 and PCT Patent Application GB2010/051108, both entitled "Apparatus And Methods For A Sealing Subterranean Borehole And Performing Other Cable Downhole Rotary Operations," and both filed Jul. 5, 2010; United Kingdom patent application having Patent Application Number GB1021787.5, entitled "Managed Pressure Conduit Assembly Systems And Methods For Using a Passageway Through Subterranean Strata," filed Dec. 23, 2010; United Kingdom Patent Application Number GB1015428.4, entitled "Shock Absorbing Conduit Orientation Sensor Housing System" filed 16 Sep. 2010; Patent Cooperation Treaty Application Number US2011/000377, entitled "Manifold String For Selectively Controlling Flowing Fluid Streams of Varying Velocities In Wells From A Single Main Bore," filed Mar. 1, 2011 and United Kingdom Patent Application having Number GB1104278.5, of the same title, filed 15 March, 2011; PCT Application Number US2011/000372, entitled "Pressure Controlled Well Construction and Operation Systems and Methods Usable for Hydrocarbon Operations, Storage And Solution Mining," filed Mar. 1, 2011 and United Kingdom Patent Application having Number GB1104278.5, of the same title, filed 15 March, 2011; United Kingdom Patent Application having Number GB1116098.3, entitled "Rig-less Abandonment Testing", filed 19 Sep. 2011; United Kingdom Patent Application having Number GB1121741.1, entitled "Rotary Stick, Slip And Vibration Reduction Drilling Stabilizers With Hydrodynamic Fluid Bearings And Homogenizers", filed 16 Dec. 2011; and United Kingdom Patent Application having Number GB1121743.7, entitled "Cable Compatible Fluid Hydrodynamic And Homogenizing Bearing Rotary Steerable System For Drilling And Milling", filed 16 Dec. 2011, each of which is incorporated herein in its entirety by reference.

The present invention claims priority to Patent Application Number GB1111482.4, which can be usable to, for example, provide a four (4) dimensional space by including the extra dimension of geologic time. Previous to this invention relating to the creation and use of a four (4) dimensional space, prior applications of the present inventor discussed the creation and use of two and three dimensional spaces, for example, Patent Application Number GB1011290.2, discloses methods and systems usable to provide a three (3) dimensional usable space within a well and Patent Application Number GB1116098.3 discloses a method usable to, for example, test the sealing of three and/or four dimensional spaces, which are sealed with cement or a settable material.

Although various aspects of these prior applications, including patent applications GB1011290.2 and GB1111482.4, teach apparatus and methods for hydraulically driven pistons, the present invention teaches the use of a bore hole piston apparatus, comprising a rig-less bore hole opening member that can be driven by hydraulics, explosions, a cable, or combinations thereof, for the formation of a geologic testing space. Further, the embodiments of the present application include apparatus and methods for using the geologic testing space to prove one or more unproven downhole apparatus, for operation within a proximally similarly aged geology of an aging well, another aging well (79), a new well (80), or a field of wells (79, 80), generally referred to as Brownfields (79) and Greenfields (80).

In addition, embodiments of the present application, claiming priority to GB1121741.1, provide apparatus and methods of forming a hydrodynamic bearing motor, usable to, for example, drive a milling surface on an arm of a milling arrangement or form the shock and vibration reducing part of fluid and/or electric motors, which can be usable by the present invention during the forming of a subterranean space.

Despite having significant merit, various new technologies disclosed in prior patent applications of other inventors can be difficult to deploy, due to the risk tolerance of Operators and the oligopolistic practices of the large service providers dominating the industry who, understandably, prefer using technology with the highest immediate return, thus making new technology development difficult.

Ultimately, before being accepted, new technology must employ field testing and further development, with various adjustments to the original invention, to provide a robust solution. However, few practitioners are willing to risk the consequences of such testing of the new technologies, particularly given the explosive nature of hydrocarbons and historic catastrophic events within the oil and gas industry.

Well operators face a series of challenges at each stage of a well's lifecycle as they seek to balance the need to maximise economic recovery and to reduce the net present value of an abandonment liability to meet their obligations for safe and environmentally sensitive operations and abandonment. When wells lose structural integrity, which may be defined as an apparent present or probable future loss of pressure or fluid bearing capacity and/or general operability, all or portions of a well may be shut-in for maintenance or suspension, until final abandonment, or may require immediate plugging and abandonment, potentially leaving reserves within the strata that cannot justify the cost of intervention or a new well.

Some of the more frequently reported structural integrity problems include a lack of production tubing centralization leading to conduit erosion from thermal cycled movement; corrosion within the well conduit system; e.g., from biological organisms or H2S forming leaks through or destroying conduits or equipment; and/or valve failures associated with subsurface safety valves, gas lift valves, annuli valves and other such equipment. Other common issues include unexplained annulus pressure, connector failures, scale, wear of casings from drilling operations, wellhead growth or shrinkage and Xmas or valve tree malfunctions or leaks at surface or subsea. Such issues comprise areas where operators are able to, or chose to, test, and there are others (such as the internals of a conductor) which they cannot, or do not test, and which may represent a serious risk to economic viability and the environment. Problems within various portions of a well, in particular the annuli, cannot be conventionally accessed without significant intervention or breaking of well barriers, e.g., with a drilling rig. Thus, these significant operations are an expensive cost and considerable safety risk to operators, who are unsuitable for conventional rig-less operations.

A primary advantage, of using drilling specification rigs for well intervention, is the removal of conduits and access to annuli during well intervention and abandonment, wherein the ability to access and determine the condition of the annuli casing and primary cement behind the production conduit or tubing can be used to make key decisions regarding the future production and/or abandonment. If well casings are corroded or lack an outer cement sheath, remedial action, e.g. casing milling, may be taken by a drilling rig to provide a permanent barrier. Conversely, the problem may be exacerbated by conventional rig-less well abandonment when blind decisions are made without cement logging access to annuli and attempts to place cement fail, thereby placing another barrier over potentially serious and worsening well integrity issues that can represent a significant future challenge, both technically and economically, even for a drilling rig.

Various method embodiments of the present invention can be usable for benchmarking, developing, testing and improving new technology relating to, for example, the gathering of empirical information that conventional rig-less operations cannot, by providing access and/or space for both measurement devices and sealing materials. Once such information is gathered, still other method embodiments can be usable for benchmarking, developing, testing and improving rig-lessly placed barriers, and milling or shredding conduits and/or casings to expose and bridge across hard impermeable strata, or cap rock formations, for placement of permanent barriers, without imbedding equipment in cement, to ensure structural integrity.

In general, age is believed to be the primary cause of structural well integrity problems. The combination of erosion, corrosion and general fatigue failures associated with prolonged field life, particularly within wells exceeding their design lives, together with the poor design, installation and integrity assurance standards associated with the aging well stock, is generally responsible for increased frequency of problems over time. These problems can be further exacerbated by, e.g., increasing levels of water cut, production stimulation, and gas lift later in field life.

However, the prevalent conventional consensus is that although age is undoubtedly a significant issue, if it is managed correctly, it should not be a cause of structural integrity problems that may cause premature cessation of production. Additionally, fully depleting producing zones through further production, prior to abandonment, provides an environment of subterranean pressure depletion that can be better suited for placing permanent barriers by lowering the propensity of lighter fluids like gas to enter, e.g., cement during placement.

The embodiments of the present invention provides lower cost rig-less methods usable for benchmarking, developing, testing and improving the accessing of annuli and for selectively placing pressure bearing conduits and well barrier elements at required subterranean depths, between annuli, when intervening in, maintaining and/or abandoning portions of a well to isolated portions affected by erosion and corrosion. This, in turn, extends the well life to fully deplete a reservoir and, further, to reduce the risk associated with well barrier element placement and the pollution liability from an improperly abandoned well.

The level of maintenance, intervention and workover operations necessary for well maintenance is restricted by the substantial conventional costs required for such work. The limited production levels of aging assets often cannot justify the conventional practice of using higher cost drilling rigs and conventional rig-less technology is generally incapable of accessing various passageways or all annuli within the well.

Therefore, well operators generally place an emphasis on removing troublesome assets from their portfolio and seek to prevent future problems using improved designs, rather than attempting to remedy a poorly designed well, which in turn precipitates a greater focus on asset disposal, well design, installation and/or integrity assurance. Passing the problem on to others with the sale of a well does not, however, solve the issue of abandoning existing and aging wells from a liability viewpoint.

When intervention is required, the risk-adverse major oil and gas companies generally prefer such operations as asset disposal and replacement, rather than remediation, and favour the sale of aging well assets to smaller companies with lower overheads and higher risk tolerances. Smaller companies, requiring a lower profit margin to cover marginal cost, are generally eager to acquire such marginal assets but, in future, may be unable to afford well abandonment, thus putting the liability back to the original owner and preventing sale or creating a false economy for the seller. Low cost reliable rig-less placements of well barrier elements, to delay or perform abandonment, is critical to large and small companies if aging assets are to be bought and sold and/or to avoid such false economies. Thus, the rig-less methods and members of the present invention, usable to place and verify well barrier elements for reliable abandonment, are important to all companies operating, selling and/or buying aging wells.

Therefore, the structural integrity of producing and abandoning wells is critical because the liability of well abandonment cannot be passed on if a well ultimately leaks pollutants to the surface, water tables or ocean environments, because most governments hold all previous owners of a well liable for its abandonment and environmental impacts associated with subsequent pollution. Hence, the sale of a well liability does not necessarily end the risk, when the asset is sold or abandoned, unless the final abandonment provides permanent structural integrity.

Method embodiments of the present invention are usable for benchmarking, developing, testing and improving of rig-less well intervention and maintenance, to extend the life of a well, by placing well barrier elements to isolate or abandon a portion of a well; and then, operating another portion of the well until no further economic production exists or well integrity prevents further extraction or storage operations. Thereafter, the well may be completely and permanently abandoned for an indefinite period of time, using embodiments of the present invention to rig-lessly and selectively access annuli for both placement and verification of well barriers, including barriers that provide a geologic testing space for said benchmarking, developing, testing and improving of new technology.

Therefore, a need exists for improved stability of drilling and directional drilling assemblies for jointed and rotary coiled string operations.

A need exists for apparatus and methods usable for benchmarking, developing, testing and improving new technology that can be usable for delaying abandonment, with low cost rig-less operations for placement of well barrier elements to increase the return on invested capital for both substantially hydrocarbon and substantially water wells, through rig-less side-tracking for marginal production enhancement, suspending and/or abandoning portions of a well, for re-establishing or prolonging well structural integrity for aging production and storage well assets, and preventing pollution of subterranean horizons, such as water tables, or surface and ocean environments.

A need exists for apparatus and methods usable for benchmarking, developing, testing and improving new technology that can be usable for small operating foot print rig-less well barrier element placement operations, which are usable to control cost and/or perform operations in a limited space, e.g. electric line or slickline operations, on normally unmanned platforms, from boats over subsea wells or in environmentally sensitive area, e.g. permafrost areas, where a hostile environment and environmental impact are concerns. A related need also exists for apparatus and methods usable for benchmarking, developing, testing and improving new technology usable for working, within a closed pressure controlled envelope, to prevent exposing both operating personnel and the environment to the risk of losing control of subterranean pressures if a well intervention kill weight fluid column is lost to, e.g., subterranean fractures.

A need exists for apparatus and methods usable for benchmarking, developing, testing and improving new technology usable for avoiding the high cost of drilling rigs with a rig-less system capable of suspending, side-tracking and/or abandoning onshore and offshore, surface and subsea, substantially hydrocarbon and substantially water wells, using published conventional best practices for placement of industry acceptable permanent abandonment well barrier elements.

A need exists for apparatus and methods usable for benchmarking, developing, testing and improving new technology that can be usable for preventing risks and for removing the cost of protecting personnel and the environment from well equipment contaminated with radioactive materials and scale by rig-lessly placing abandonment barriers and leaving equipment downhole. A further need exists for apparatus and methods usable for benchmarking, developing, testing and improving new technology, which can be usable to rig-lessly side-track or fracture portions of a well for disposing of hazardous materials that can result from circulation of the well's fluid column during suspension, side-tracking and abandonment operations.

A need exists for apparatus and methods usable for benchmarking, developing, testing and improving new technology, which can be usable for rig-lessly accessing annuli to measure whether acceptable sealing cementation exists behind casing, and to rig-lessly mill the casing and to place cement if acceptable cementation does not exist. A further need exists for apparatus and methods usable for benchmarking, developing, testing and improving new technology that can be usable to verify the placement of well barrier elements, during rig-less operation, to ensure the successful settable material bonding and sealing of a well's passageways has occurred or whether further remedial work is required.

A need exists for apparatus and methods usable for benchmarking, developing, testing and improving new technology, which can be usable for rig-lessly accessing annuli presently inaccessible, particularly with minimal foot-print conventional slickline rig-less operations, including bypassing annulus blockages, created, e.g., by production packers, during placement of permanent well barrier elements within selected portions of a well, across from cap rock and other impermeable formations needed to isolate subterranean pressures over geologic time.

A need exists for apparatus and methods usable for benchmarking, developing, testing and improving new technology, which can be usable for a plurality of permanent well barriers that are verifiable through selectively accessed annuli passageways with rig-less operations, usable with conventional logging tools to maintain the structural integrity of a well prior to final abandonment, and that also provide access for placing permanent barriers to ensure structural integrity of the strata bore hole thereafter.

A need exists for apparatus and methods usable for benchmarking, developing, testing and improving new technology, which can be usable for marginal production enhancement that is usable to offset operating costs until final abandonment occurs, including rig-lessly providing well integrity, while waiting until an abandonment campaign across a plurality of wells can be used to further reduce costs.

A need exists for apparatus and methods usable for benchmarking, developing, testing and improving new technology, which can be usable to reduce the abandonment liability for operators while meeting their obligations of structural well integrity for safe and environmentally sensitive well operations, suspension and abandonment, in an economic manner, that is consistent with providing more capital for exploration of new reserves to meet our world's growing demand for hydrocarbons, by minimising the cost of operations, suspension and abandonment with lower cost rig-less suspension, side-tracking and abandonment technologies.

A need exists for apparatus and methods usable for benchmarking, developing, testing and improving new technology that can be usable to verify rig-less well abandonments to facilitate a market where the reduction of the well abandonment liability allows larger operating overhead companies to sell marginal well assets to smaller, lower overhead, operating companies, i.e. by lowering the risk of a residual abandonment liability, to prevent marginal recoverable reserves from being left within the strata, because higher operating overhead requirements made such recoverable reserves uneconomic.

Finally, a need exists for systems and methods that are usable with existing and new technologies to provide sufficiently inexpensive methods, requiring few or low-cost resources, for forming a geologic testing space to test new or unproven downhole apparatus.

Although the embodiments of the present invention can be considered to create a new market from an existing market, this generalization can be evident in several significantly important prior inventions, for example, the invention of the steam engine, which resulted in the formation of a new market that has been historically summarized as the industrial revolution; the invention of a logging while drilling apparatus, which has formed a directional drilling market; and the invention of a positive displacement mud motor, which has formed a horizontal drilling market, wherein the conventional and prior art apparatuses of the existing markets, at the time of each of these inventions, could not meet the same required needs. Hence, the present invention may result in the formation of a market for testing unproven downhole apparatuses, simply because no such market for the downhole testing of apparatus presently exists.

Therefore, the present invention not only provides an important solution to the need for downhole testing and proving of apparatus, it provides a new market in downhole testing that is necessary because conventionally operating a down hole apparatus is, in practice, more art than science. Science can be considered to be literally "as blind as a bat," because, for example, it relies entirely upon surface indications and subterraneanly transmitted and reflected signals of downhole tools, which are located within a hazardous geologic environment that is subject to extreme forces, substances, pressures and temperatures, miles below the surface of the earth. Hence, practitioners generally rely more on empirically proved operations than on scientific theories of operation.

Substances, pressures and temperatures associated with the alternating layers of permeable and non-permeable subterranean strata are not foreseeable by using the bouncing of reflected signals upon subterranean reflectors of the geology, geologic fractures, and an almost infinite number of subseismic resolution events, stratigraphy and lithology. Hence, a geologic environment cannot be scientifically predicted to the accuracy of empirical downhole apparatus operating data from said geology.

Accordingly, practitioners, often avoid the use of unproven technology within a geologic environment, and use apparatuses with empirically proven operation within the expected geology, due to the potentially extreme costs and risks associated with operating within the extreme geologic forces, substances, pressures and temperatures, miles below the earth's surface.

Consequently, operation within a comparable geologic environment is ultimately the conventional measure of acceptance, wherein practitioners are generally unwilling to accept the risk of being the first to prove and use an unproven apparatus within any particular geology.

Generally, conventional practitioners would rather live with a known problem, such as harmonic resonance and vibration of a boring string, than accept the risk of testing an unproven apparatus, only to have it, for example, come apart and cause significantly more risk and cost through the process of removing lost parts from the well bore.

Accordingly, a need exists for a lower risk and lower cost system and method of proving unproven technology.

Various aspects of the present invention meet these needs.

SUMMARY

The present invention relates, generally, to space provision systems and methods usable to form a geologic testing space, for example, within an abandonment liability well, for proving the operation of an unproven downhole apparatus (i.e., new technology) by using, for example, a hydrodynamic bearing boring apparatus (1A, 1E, 1BM, 9AA, 92D) or a bore hole piston apparatus (1A, 1AF, 92A-92C, 92E-92G), wherein both of these apparatus comprise a rig-less bore hole opening member (92), which can be driven, in part, by hydraulics. In addition, the bore hole opening members can be further drivable by an explosion, a cable, or combinations thereof.

Embodiments of the present application provide significant improvements to the existing art, wherein the geologic testing of the present invention is usable to empirically prove any new or unproven downhole apparatus within a geologic environment, including, but not limited to, apparatus or new technologies of the present inventor, for proven use on wells with similar geologic conditions.

The embodiments are usable in isolation, or can be combined, for example, with various technologies and methods of the present inventor to provide systems and methods for using a rig-less apparatus to convert the tangible well liability of abandonment into the tangible asset of a geologic test well, which can be usable to prove the rig-less or rig operation of an unproven downhole apparatus, such as a hydrodynamic bearing that may be used within any rotary drill string, and which could potentially improve the efficiency of all rotary drilling operations by reducing the effects of adverse shocks, vibration, whirl and harmonic resonance of rotary operations.

Preferred embodiments of the present invention can provide a space provision system of apparatus and method (10, 10A-10H) for forming a geologic testing space for proving an operation of at least one unproven downhole apparatus (78, 92), within an aged geology and during the rig-less abandonment of an aging well to, in use, reallocate operation of said at least one unproven downhole apparatus, from unproven to proven operation, within a proximally similarly aged geology of said aging well, another aging well (79), a new well (80), or a field of said wells (79, 80)

Preferred embodiments may comprise at least one hydrodynamic bearing boring apparatus (1A, 1E, 1BM, 9AA, 92D) or a bore hole piston apparatus (1A, 1AF, 92A-92C, 92E-92G), wherein the at least one unproven downhole apparatus can comprise a rig-less bore hole opening member (92) that can be driven, in part, by hydraulics, wherein the rig-less bore hole opening member can be further drivable by an explosion, a cable, or combinations thereof, and can be deployable through an upper end of said aging well, within one or more conduits having at least an inner bore hole within a wall of at least one concentric surrounding bore that is engagable by said rig-less bore hole opening member, during abandonment of a lower end of said aging well, such that the rig-less bore hole opening member can open said inner bore hole axially along, and radially into, the wall of the at least one concentric surrounding bore. Debris (91), from the opening of said inner bore can be disposed and compressed within the lower end of the aging well for placement of a settable pressure sealing material. The settable pressure sealing material can be placed axially above the debris and within the wall of the at least one concentric surrounding bore, at the lower end of the aging well, to provide a proximal geology above the settable pressure sealing material that is comparable to at least one portion of a geology of the aging well, a geology of another aging well, a geology of a new well or a geology of the field of wells to form, in use, the geologic testing space.

Preferred embodiments further provide a geologic testing space usable to empirically measure operating parameters of the at least one unproven downhole apparatus (78, 92), wherein the geologic testing space comprises at least one unproven down hole apparatus (78) to provide empirical data for adapting or proving the at least one unproven downhole apparatus to, in use, reallocate operation of the at least one unproven downhole apparatus, from unproven to proven operation, within the geologic testing space for use within a similar geologic environment of the aging well, the another aging well, the new well, or the field of said wells.

Various embodiments may provide a rig-less bore hole opening member (92) comprising a rig-less cutting apparatus to disengage debris (91) from engagements that prevent disposal and compression of said debris within a lower end of an aging well.

Related embodiments can provide a rig-less bore hole opening member (92, 1A,1E, 1BM, 92D), comprising at least one hydrodynamic bearing (1) that is disposed about a shaft (2) and an outer wall (5) of a cutting structure (112) and positioned within said wall of said concentric surrounding bore (7), with at least one periphery arced wall (4) radially extending from, and arranged about, a circumference of a conduit shaft housing (14, 14A), and about at least one inner wall (6) that is adjacent to at least one associated hydrodynamic profiled wall (3). The rig-less bore hole opening member can be rotatable by or about the shaft to displace fluid axially along said at least one inner wall that is anchored by combined frictional engagements of the fluid, at least one associated hydrodynamic profiled wall (3), at least one inner wall (6), at least one periphery arced wall (4), and/or the wall of the at least one concentric surrounding bore (7) to force the fluid between an adjacent set of at least two of said walls. The embodiments include fluids that can be displaced to form a pressurized (8) cushion that is fluidly communicated to and from a set of at least two walls to, in use, operate cutting structures (112, 116) to form the debris (91), while lubricating and dampening associated rotational shocks and vibrations with a shearing of frictional engagements when bearing the shaft, during rotation of the cutting structures within the wall of the at least one concentric surrounding bore.

Various embodiments may provide a rig-less bore hole opening member (92), comprising a plug, a diaphragm, or combinations thereof, wherein a rig-less bore hole opening member (92) can be placed adjacent to debris (91) for disposal and compression of said debris within the lower end of an aging well, by using differential fluid pressure across a bore hole piston apparatus. The embodiments can include injecting fluid into one or more conduits to form a high pressure region, at a first side of said bore hole piston apparatus, and a lower pressure region, at a second side of said bore hole piston apparatus, to operate said rig-less bore hole opening member axially along and radially into the wall of at least one concentric surrounding bore.

Other embodiments may provide a rig-less bore hole opening member (92) comprising a hydraulic jar, an explosive, or combinations thereof, for urging the disposal and compression of debris (91) within a lower end of an aging well.

Various other embodiments may provide a rig-less bore hole opening member (92) that comprises a firing gun (92A), which can be placeable by deployment string, for explosively firing a piston (95) from a housing (96), wherein said piston can be adaptable with an orifice, valve, or combinations thereof, to relieve trapped pressure from beneath said piston when fired.

Still other embodiments may provide a rig-less bore hole opening member (92) comprising a cable tension compression device (92B, 92E 92F, 92G) for buckling (99) one or more conduits to form debris (91), by using a tensionable cable (67) that can be anchored (102, 103) with a pulley (105) at one or more ends, thereof, to axially compress said debris relative to said pulley.

Related embodiments may provide a cable passing through at least one eccentric orifice (100) of a plurality of plates (101) that are spaced within one or more conduits, and wherein tensioning cable alignments of said eccentric orifices can urge the plurality of plates radially into an inner bore to buckle (99) said one or more conduits axially along, and radially into, the wall of at least one concentric surrounding bore to form the debris.

Various embodiments provide a rig-less bore hole opening member (92) that can compress debris axially along or radially into the wall of at least one concentric surrounding bore.

Other embodiments may provide a logging tool apparatus having a transponder, receiver, or combinations thereof, wherein the logging tool apparatus can be placed in the rig-less bore hole opening member (92), the downhole apparatus (78), a wellhead, the geologic testing space, the settable pressure sealing material, or combinations thereof, and wherein said transponder or receiver can be placeable within a shock and compression resistant enclosure to send signals through fluids or casings of said aging well.

Related embodiments may provide a logging tool apparatus that can empirically measure (93) operating parameters of at least one unproven downhole apparatus to form at least one measurement, comprising tolerances, rotary speeds, shocks, vibrations, stick-slip, whirl, harmonic resonances, or combinations thereof, for operation of the at least one unproven downhole apparatus (78) within subterranean substances, pressures and temperatures of said aged geology.

Other related embodiments may provide a logging tool apparatus that empirically measures (93) and provides associated empirical data of subterranean strata geologic periods and epochs, that can be similar to another aging well, a new well or a field of wells.

Other embodiments may provide a production infrastructure for hydraulically operating the rig-less bore hole opening member (92) and for fluidly accessing said aging well through one or more conduits.

Various related embodiments may provide a production infrastructure usable to extract production from a subterranean resource.

Other embodiments may side-track an aging well using a rig-less bore hole opening member (92) or an unproven downhole apparatus (78).

Various other embodiments may prove an unproven downhole apparatus (78), which can be deployable and operable within one or more conduits, and a geologic testing space, that is provided by a rig-less bore hole opening member (92), for proven use across a plurality of proximally similar geologic environments of another aging well (79), a new well (80) and/or a field of said wells (79, 80).

BRIEF DESCRIPTION OF THE DRAWINGS

Preferred embodiments of the invention are described below by way of example only, with reference to the accompanying drawings, in which:

FIG. 1 illustrates the embodiment of a system for forming usable geologic space for side-tracking and the development and testing of various new technologies, including apparatuses of the present inventor.

FIGS. 8 and 9 illustrate prior art that can be associated with the FIG. 10 embodiment of the present invention.

FIGS. 10 and 11 illustrate explosive and line tension embodiments for forming space within a subterranean well, which are usable with various other embodiments of the present invention.

FIG. 12 shows an apparatus of the present inventor usable with various embodiments of the present invention.

FIGS. 13 to 16 depict embodiments of hydrodynamic bearing milling motor arms usable with various other embodiments.

FIG. 22 depicts an apparatus of the present inventor usable with various embodiments of the present invention.

FIGS. 23 to 27 depict various apparatuses and methods of the present inventor usable with various embodiments of the present invention.

FIGS. 28 and 29 illustrate a side-tracking embodiment of the present invention using various apparatus of the present inventor.

Figure 2:
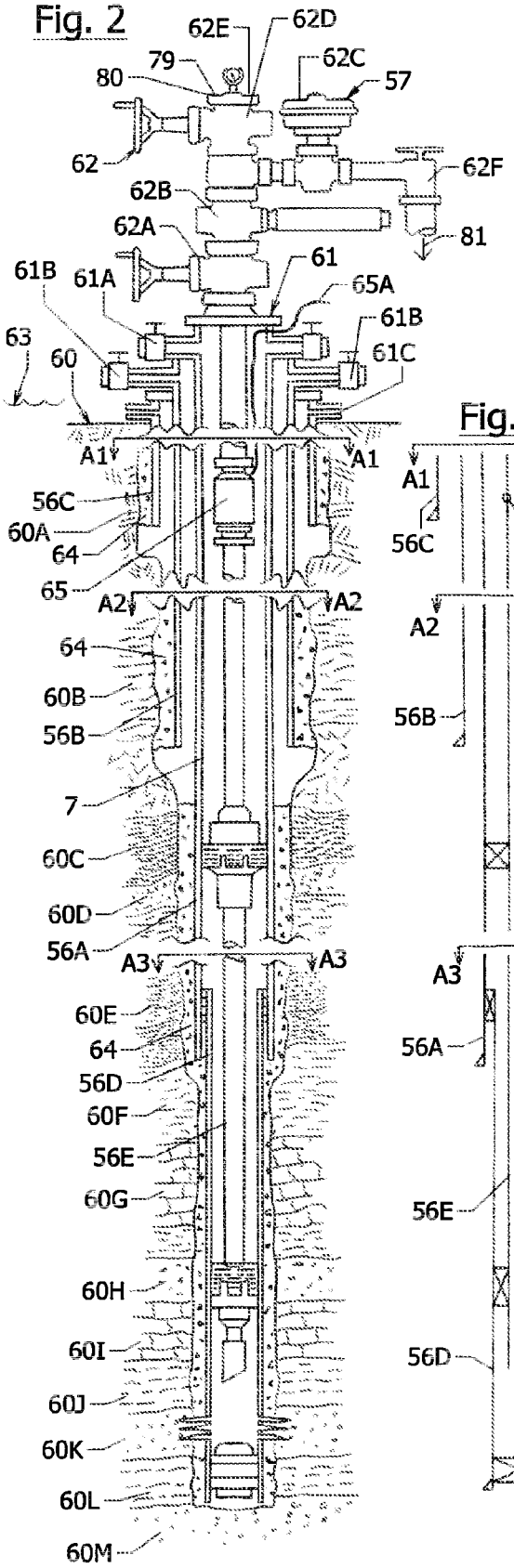
FIGS. 2, 2A and 3 to 7 depict diagrammatic subterranean well schematics for various well types usable with various embodiments of the present invention.

Embodiments of the present invention are described below with reference to the listed Figures.

DETAILED DESCRIPTION OF THE EMBODIMENTS

Before explaining selected embodiments of the present invention in detail, it is to be understood that the present invention is not limited to the particular embodiments described herein, and that the present invention can be practiced or carried out in various ways. The disclosure and description herein is illustrative and explanatory of one or more presently preferred embodiments and variations thereof, and it will be appreciated by those skilled in the art that various changes in the design, organization, order of operation, means of operation, equipment structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views as desired for easier and quicker understanding or explanation. As well, the relative size and arrangement of the components may differ from that shown and still operate within the spirit of the invention.

Moreover, it will be understood that various directions such as "upper," "lower," "bottom," "top," "left," "right," and so forth are made only with respect to explanation in conjunction with the drawings, and that the components may be oriented differently, for instance, during transportation and manufacturing as well as operation. Because many varying and different embodiments may be made within the scope of the concepts herein taught, and because many modifications may be made in the embodiments described herein, it is to be understood that the details herein are to be interpreted as illustrative and non-limiting.

Referring now to FIG. 1, a flow chart of a space provision system (10) embodiment (10A) is depicted, showing the identification of wells available for abandonment (82) and consummation of an agreement (83) representing, for example, a contractual rental or sale agreement (84) between a technology (85) and abandonment liability owner (86) for space usage rights (87) and optionally infrastructure usage rights (88), for the purposes of forming a geologic testing space for proving the operation of an unproven downhole apparatus (78, 92) within an aged geology, during the rig-less abandonment of an aging well.

A space provision system can be usable to compress well apparatuses and debris (91) with a compression device (92) for forming a usable geologic space for placement of an abandonment plug (89), to satisfy an abandonment liability and provide integrity for developing new technology (78), for example further space formation devices (92) to reduce the resources required for abandonment, or side-tracking drilling (59) and milling assemblies (9) or hydrodynamic bearings (1) to for example, more effective exploit Brownfields (79) and Greenfields (80) with less resources, to the benefit of the regional and global private and public benefit (90).

Empirical measurements (93) may be taken with logging tools or a transponder may be placed in a protective shock absorbent housing (66 of FIG. 22) to provide empirical data to design, redesign, test and field prove new technology (78) in the development of Greenfield (80) and Brownfield (79) wells (57). Various technologies described in the following patent applications: UK patent number 2465478 and UK patent application numbers GB1011290.2, PCT GB2010/051108, GB1021305.6, GB1111482.4, GB1104278.5, GB1104278.5, GB1121743.7, GB1121741.1 and PCT patent application numbers US2011/000377 and US2011/000372, may be tested and further developed with the present space provision system. While new technology of the present invention are emphasised, virtually any downhole technology that will fit through the bore of the well (57) may be tested and field proven, subject to the resources available. Hence, the present space formation system can be further usable to create a market for testing and field proving the new technology, wherein said usable space becomes a tradable product.

The resource cost of drilling rig (58A of FIG. 18) and even some rig-less operations (58C of FIG. 19) is, generally, such that a usable space for testing and field proving of downhole tools, deployable within the realistic environments provided during the abandonment of wells (57) and with significantly less resource intensive rig-less jointed pipe (58B of FIG. 17) and coiled string (58D of FIG. 20) operations, represents a significant improvement in the development of new technology and hence is marketable. For example, a company owning the usage right for the usable space formed during the abandonment may offer to test and field prove technologies in exchange for a participating ownership in such technologies or for monetary gain.

Given the relatively low capital investments required for rig-less abandonment, wherein the present space provision system represents a new technology requiring minimalistic resources, and the lack of competitive forces in the present oligopolistic service provider market, well abandonment represents a significant resource cost to liability owners and an opportunity for new technology companies to compete with the goliath service providers who domination the market. Alternatively, the ownership of minimalistic resources and the opportunity to test new technologies with one of said goliath service providers will force competition in a relatively uncompetitive market, compared to the 1970's and early 1980's. In all cases, the use of fewer resources provides significant benefit to regions and our global society (90) facing peak oil and dramatic liquid hydrocarbon price increases, because said resources may be reallocated to Brownfield (79) and Greenfield (80) developments needed to limit said dramatic liquid hydrocarbon price increases associated with peak oil.

Referring now to FIGS. 17 to 21, illustrating various elevation views of rigs (58) usable with the system and method of the present invention, and showing what is conventionally described as drilling rig (58A) and rig-less (58B, 58C and 58D) arrangements above example slices through subterranean wells (57) and strata (60). Drilling rigs (58A) require the most resources for operation, with a large derrick (94) and associated hoisting equipment often capable of lifting over a million pounds, with associated large fluid pumping and storage capacity resources. While either coiled or jointed pipe conduit string may be used on a drilling rig (58A), high strength and torque jointed conduits are generally used. In general, drilling rigs have the most rugged and robust equipment specification that may be orders of magnitude difference resource operations costs compared to coiled string and other rig-less arrangements. Coiled tubing rigs, generally termed as drilling "rig-less," generally require significantly less resources than drilling rigs, but considerably more than, for example, jointed string rig-less arrangements (58B) and cable rig-less arrangements (58D). Consequently, when well abandonment and boring string operations use rig-less arrangements, said operations require less resources.

Drilling rigs (58A) are generally efficient for quickly boring and constructing a well into the geologic periods and epochs, miles and kilometers below the earth's surface. However, such resource usage, generally, exceeds what is required for well abandonment, testing and development of new technology. Hence, where using relatively low resource usage rig-less operations is relatively inefficient to, for example, construct a well (57) to 10,000-feet or 3,048 meters, rig-less arrangements (58B, 58C and 58D) are more resource efficient than drilling rigs (58A) if said well is already constructed and the objective is to place a permanent abandonment plug (89), and test and develop new technology within regional subterranean environments, similar to those where developed tools will be used. Consequently, compared to other rig-less approaches, the present space provision system will approach and potentially become the lowest resource usage system and method within the industry for abandoning wells and testing downhole tools, thus freeing resources for reallocation to further new technology (78), Brownfield (79) and/or Greenfield (80) development.

Figure 17:
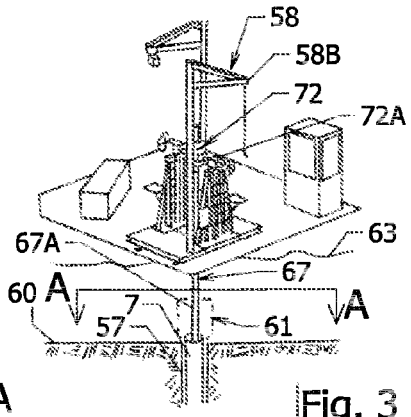
FIGS. 17 to 21 illustrate various rig and rig-less arrangements usable with various wells types A to D applicable to various embodiments of the present invention.

FIG. 17 depicts an isometric view of a rig-less jointed pipe (72, 72A) handling (58B) rig-like (58) arrangement, wherein the rig (58) is located above sea level (63) or ground level (60) and handles individual (72A) jointed pipe (72) to form a rig-less jointed pipe string (67A) operable within a well (57) bore (7) through an associated wellhead (61). Such rig-less pipe handling systems are usable to prove unproven (78) rotary string (67) apparatuses.

Figure 18:
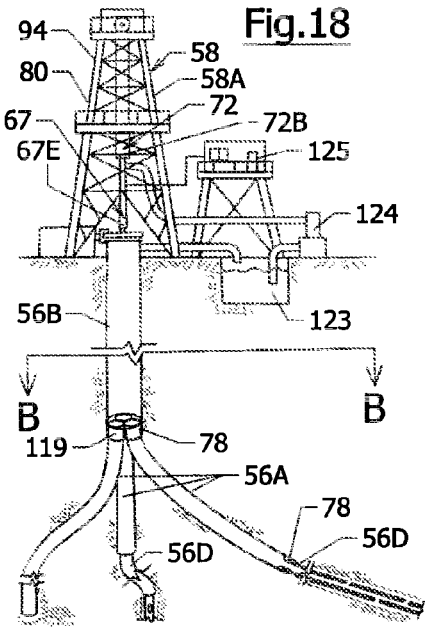

Referring now to FIG. 18, an elevation view with a slice through strata and the well removed is depicted. The Figure shows a rig (58), and includes a drilling nature (58A) with a derrick (94), fluid or mud pits (123), pumps (124) and a control room, conventionally called a dog house (125). The well comprises a Greenfield (80) development using a chamber junction (119) and simultaneous flow string chamber junction (122 shown in FIGS. 26 and 27) which has been proven in an abandoned well previously, wherein said technology is particularly useful for fracturing operations, for example shale gas fractures.

Figure 19:
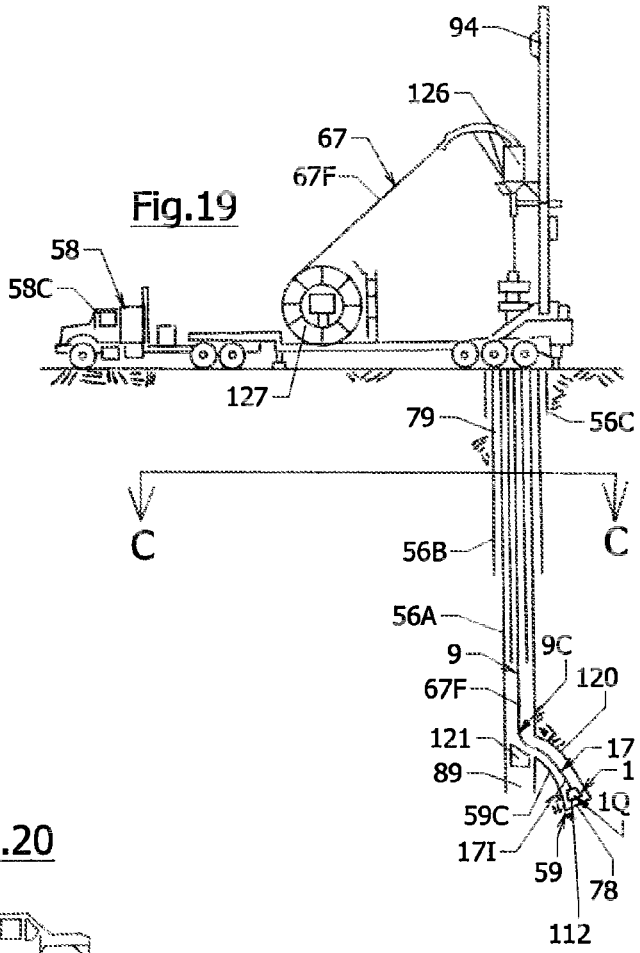

FIG. 19 shows an elevation view of a slice through a well and strata, illustrating a coiled string (67F) and a coiled tubing rig (58C) with an injector head (126) and derrick (94), working on a brownfield (79) to prove unproven technology after abandoning the lower end of the well.

Figure 20:
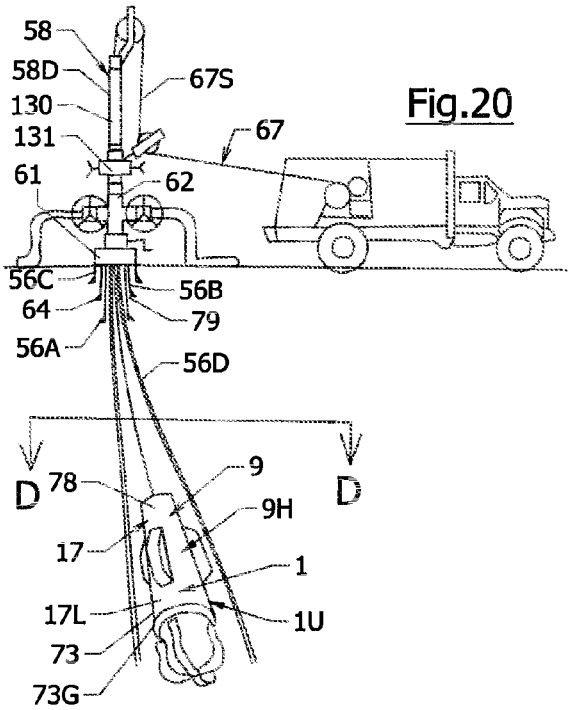

Referring now to FIG. 20, the Figure shows an elevation view through a slice through the well and strata, showing a cable rig (58D) arrangement using a coiled string (67) cable (67S) through a lubricator (130), blow out preventer (131) wellhead (61) and casing (56A, 56B, 56C, 56D) to deploy a pendulum boring piston (73, 73G) with a motor (17L) and jointed directable pendulum string (9, 9H), having a hydrodynamic bearing (1, 1U) usable to reduce the friction, shock and vibration associated with cable rotary tool boring.

Figure 21:
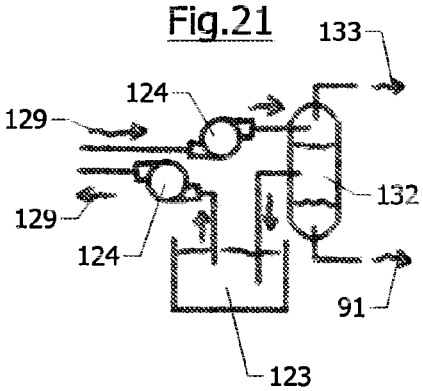

FIG. 21, illustrates a schematic of a mud pit (123) arrangement usable with a coiled string arrangement, for example (58D) of FIG. 20 or (58C) of FIG. 19, wherein fluid returned (129) in a pressure controlled manner may be run through a separator (132) to remove hydrocarbons or gases (133), disposing of debris (91) and returning (129) circulated fluid to a mud pit (123) or closed tank system, for pumping (124) back to the boring operations. Underbalanced drilling may be accomplished in this manner using rig-less operations, to further improve both penetration rates of boring and productivity from subterranean production resources, providing another example opportunity for reducing resource costs with a space provision system of the present invention.

Embodiments of the present space provision system can be operated with rigs (58B-58D) to form a geologic testing space for proving an unproven downhole apparatus (78, 92) within an aged geology, during the rig-less abandonment of an aging well to, in use, reallocate operation of said unproven downhole apparatus from unproven to proven operation with rigs (58A-58D) within a proximally similarly aged geology of said aging well, another aging well (79), a new well (80), or a field of said wells (79, 80), typically referred to as Brownfields (79) and Greenfields (80).

Figure 2A:
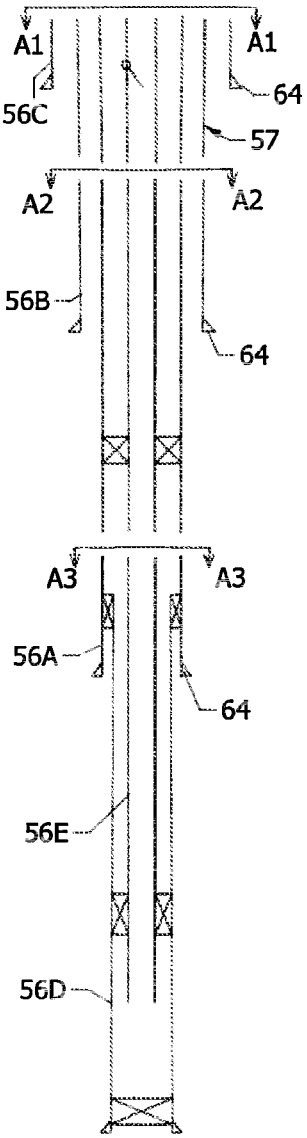
Figure 3:
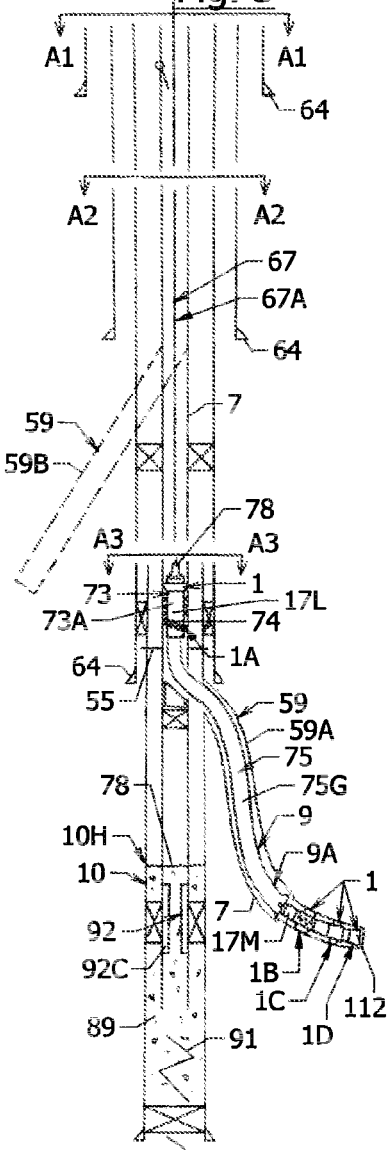

FIGS. 2, 2A and 3 show various diagrammatic elevation views of a subterranean slice through various example wells (57) and strata types applicable to the present invention. As subterranean wells (57 of FIG. 2) have many components, simplified well schematics (e.g. 57 of FIGS. 2A and 3) are conventionally used to provide focus upon communicated aspects. Hence it is to be understood that a schematic well diagram (e.g. 57 of FIG. 2A) is equivalent to a more detailed well diagram (e.g. 57 of FIG. 2, below the section line A1-A1), and each of the wells described in FIGS. 3 to 16 are similar to FIG. 2, except where noted.

Generally, a well's (57) architecture comprises various cemented (64) and uncemented casing (56A to 56D) and strata (60A to 60M) bores (7). Casings may comprise various sizes, for example, (56D) may represent a 7" liner, (56C) a 30" conductor, (56B) a 13⅜" casing, and (56A) a 9⅝" production casing, within which an uncemented annulus and production conduit (56E) may exist. For a space formation system, devices may be used to compress, for example, the production conduit (56E) forming debris and potentially containing or covered with engaged debris, e.g. NORM or LSA scale, wherein the conduit (56E) and other associated apparatuses and debris may be compressed within the uncemented annulus of the production conduit (56A) to form a usable space within said production conduit.

With regard to new technology (78), Brownfield (79) and Greenfield (80) development, or the proving of unproven (78) apparatuses, it is critical to understand that said new technology (78) will be subjected to diverse pressure, temperature and the forces stratigraphy that is vastly different from one well to the next and which has formed over hundreds of millions of years. Consequently, the art and practice of the well construction and production industry is to rely more upon empirical data that theoretical data give the dangers of exposure to subterranean substances, pressures and temperatures, where geothermal water may be as dangerous as explosive hydrocarbons in various instances. Hence, the field testing and proving of new technology in similar conditions to those expected is of critical importance to practitioners.

Unfortunately, the common test well for service providers is typically shallow, incomparable and generally discounted by those skilled in the art.

The presently described space provision system can be usable to test and field prove new technologies, like hydrodynamic bearings (1) and directable hydrodynamic bearing pendulum boring strings (9), tested within the controlled environment of a subterranean well, wherein the lower end has been made relatively safe through said space provision system abandonment, leaving room within the well to test new technology in close to actual conditions. It is to be understood that the strata below the FIG. 2, FIG. 2A, and FIG. 3 line A1-A1 represents any of the Quaternary and Neogene period epochs, with the strata below line A2-A2 representing any of the Paleogene period Oligocene, Eocene and Paleocene epochs, and strata below A3-A3 represents any Cretaceous, Jurassic, Triassic, Permian or Carboniferous period late, middle and early epochs. The strata below lines A-A of FIG. 17, B-B of FIG. 18, C-C of FIG. 19, and D-D of FIG. 20 represents any of the lines A1-A1, A2-A2 or A3-A3 geologic period epochs.

FIGS. 2 and 2A show an elevation slice through the well and schematic views, respectively, of a well (57) with a valve tree (62), and illustrate a slice through said well's subterranean portions and wellhead (61), securing casing (56A-56C) cemented (64) below strata level (60), which may be either a ground level or mud line below sea level (63).

The above ground (60) or sea level (63) valve tree (62), as shown, may be adapted for subsea use, wherein the conventional valve tree configuration represents a primary (61B) and secondary (61A) master valve, usable with the production valve (62C) to flow production through the flow line (62F). If the tree cap (62E) is removed and a rig (e.g. 58D of FIG. 20) is erected to the tree's upper end, the swab valve (62D) and master valves (62A, 62B) may be opened to access the production conduit (56D) through the safety valve (65), wherein said safety valve may be operated with a control line (65A). A conventional wellhead (61) generally uses multiple annulus valves (61A, 61B) to access annulus between the various well conduits (56A, 56B, 56C) with larger shallow annuli exposed to normally pressured formations left open or without valves (61C).

The strata (60) access by any well (57) bore may be generally classified by mineral and chemical composition, by the texture of the constituent particles and by the processes that formed them, which separate rocks into igneous, sedimentary, and metamorphic. Igneous rocks may comprise, e.g., granite and basalt, which are particularly hard to bore through. While granite is often bored within wells, the majority of strata targeted for boring comprises sedimentary rocks formed at or near the earth's surface by deposition of either clastic sediments, organic matter, or chemical precipitates (evaporites), followed by compaction of the particulate matter and cementation during diagenesis. Sedimentary rocks may comprise, for example, mud rocks, such as mudstone, shale, claystone, siltstone or sandstones and carbonate rocks such as limestone or dolomite. Metamorphic rocks are formed by subjecting any rock type (including previously formed metamorphic rock) to different temperature and pressure conditions than those in which the original rock was formed, and hence may be prevalent in many well bores.

Referring now to FIG. 3, the Figure illustrates using a space providing system (10) embodiment (10H), shown as a compressing device (92) comprising a slideable piston annular blockage bypass straddle (92C), and used to compress debris (91), for example scale chemically removed and hydraulically jarred into the well and strata prior to placing an abandonment plug (89) to allow the side-tracking of the well of FIG. 2A, using a coiled pendulum drill string (67, 67A), comprising a boring piston (73) embodiment (73A) with a reactive torque tractor (74) directable boring string (9, 9A), using a motor (17L) to rotate a wireline deployable jointed string (75, 75G) and a second in-line motor (17) to rotate an upper and lower cutting structures (112), which can be usable to bore said side-track (59) embodiment (59A), which can be placeable, retrievable and operable via said tensionable coiled string (67) and can pump pressure through said previously formed bore (7), with fluid pressure applied through and about said conduit boring piston by one or more surface or conduit fluid pumps or motors. The space provision system (10) can be usable to bore a second side-track (59B) and optionally to produce from any marginal production resources found prior to placing a final abandonment plug to permanently isolate said side-tracks (59A, 59B). Further shown in FIG. 3 are hydrodynamic bearings (1, 1B, 1C, and 1C).

Referring now to FIGS. 1, 8 to 12 and 22, the Figures include space provision system (10) members (10D, 10E, 55, 66) and prior art (51, 52). FIGS. 8 and 9 show isometric views of a prior art shotgun (51) and shotgun shell (52) components, respectively, illustrating a shell (52) with casing (52A) placeable in the gun's chamber (51B). Contact of a firing pin with the primer (54) within the shell orifice (52B) initiates an explosion of gun powder within the shell, comparable to a deployment conduit (56E, 56B, 56C), usable to fire a wad (53, 95A) and functioning as a piston (95) to push various bullets, which is comparable to the severed end of the conduit crushed (56E, 56A, 56B, respective to the containing conduits) from the gun's barrel (51A), which can be comparable to a containing conduit (56A, 56B, 56C, respective to the compressed conduits), with an uncemented inner bore. For example, the wad (92) may: compress conduit (56E) within the barrel conduit (56A), compress conduit (56A) with the barrel conduit (56B), and so on and so forth. A pinning arrangement may be used to anchor various well conduits during explosive compression or milling as described in FIG. 12. Alternatively, various compression devices (92) may use cables to enlarge a bore by compressing debris into a well's lower end as described. Additionally, empirical measurements may be made during and after compression and/or during the downhole proving of unproven apparatuses using various embodiments.

Referring now to FIG. 22, showing an isometric view of shock absorbing apparatus (66) of the present inventor and usable to place a transmitter within a well bore for measurements about or below components, compressed by a space provision system of the present invention (e.g. those described in FIGS. 5-7 and 10-11). The transmitter may be engaged within a transmitter housing (66D), which may be placed in contact with casing (e.g. 56A-56D of FIGS. 2 and 2A) through a cover (66C) or the housing (66A), wherein said contact may remain when the sensor is cushioned (66B) from adverse shocks and forces when, for example, compressing well components using space provision system operations, thus allowing transmission of empirical data through casings to a surface wellhead.

A sensor and/or transponder may be separated from compression and jarring forces by at least one shock absorbing frame, spring, moveable bearing arrangement, gelatinous material or protective stabiliser providing, in use, continuous ultrasonic or electrical contact with the conduit wall extending to the wellhead conductor for transmission of a signal through said conduit wall while inhibiting stresses transmitted to said sensor or transponder, from, e.g., crushing of conduits below a annulus conduit crushing piston, usable to expose the production casing for logging of primary cementation behind, placement of a well barrier element, and/or benchmarking, developing, testing and improving of new technology.

Conventional logging generally occurs within the innermost passageway and is unable to determine the state of primary cementation about the casings because logging tools within the production conduit cannot contact the casings. Various method embodiments of the present invention are usable to form a geologic space where logging, to confirm primary cementation adjacent to conduits, may occur. Signals may, e.g., be broadcast from the logging tool with reflected signals collected by a different portion of the logging tool, or signals may be passed between the wellhead, surface or subsea location and a downhole transmitter or receiver. Using logging tool method embodiments of the present invention, measurement signals can be engaged with the circumference of the conduit walls to provide sonic, acoustic or various other signals forms measuring, e.g., the response time of signals passing through bonded and unbonded conduit cementation to measure the degree of bonding and/or cementation present. The process may be visualized as ringing or pinging a glass and measuring the sound or vibration received to determine if the glass is free standing within a liquid or tightly cemented in place.

Signal transmitters and/or receivers are engagable with conduits or annulus fluids through penetrations or through annulus wellhead openings. A signal may be sent from the wellhead or from and an external transmitter which functions in a similar manner to a VSP logging tool used to calibrate seismic data, wherein it can be usable to see the existence of primary cementation adjacent to the strata bore and can be calibrated with logging data carried out during and/or after construction of a well.

Dependent on the result of the logging measurements, various other members of the present invention system of members are usable to place temporary or permanent well barrier elements within the well at the appropriate subterranean depths to meet industry best practices to avoid potential future leak paths and/or simulate a rig abandonment by placing cement plugs across casings. Additionally, embodiments may be cable string compatible and are thus usable with either the rig-less arrangement or the minimalistic pressure controlled arrangements for permanently abandoning a subterranean well in a rig-less manner.

FIG. 12 illustrates a diagrammatic elevation view of a conduit pinning arrangement (55), with only a portion of the well (57) bore (7) elevation radial cross section shown below an upper right hand transverse side view elevation cross section of the pinning shaft member's (55A, 55B, 55C) diameters, in differing left hand side and right hand pinning shaft configurations, shown in the upper right. A flexible shaft (55A) and boring bit (55D) may be used to bore through various casing (56) conduits (56A, 56B, 56C), with the flexible shaft (55A) usable as a spine for linked pinning conduit (55C) arrangement (55), that may be combined with securing and/or stiffening partial conduit member (55B) to anchor conduits (55A, 55B and 55C) together. Such pinning arrangements can be usable in, for example, the drilling, milling and space provision operations shown in FIGS. 3 to 7 and gun like compression of FIG. 10.

FIGS. 10 and 11 illustrate diagrammatic elevation slices through a subterranean well, showing example space provision system (10) explosive member compression device (92) embodiment (10D), and cable member embodiment (10E), respectively. Earlier described UK patent applications GB1011290.2, PCT GB2010/051108, GB1111482.4 and GB1116098.3 describe further usable space provision system (10) members, e.g. axial compression and/or radial compression plug and/or diaphragm piston compression devices (92) or hydraulic jar and/or explosive compression devices (92), for forming low resource cost usable subterranean spaces, thus reallocating resources that would have otherwise been used for satisfying an abandonment liability.

Referring now to FIG. 10, the Figure illustrates an elevation diagrammatic view of a slice through a subterranean well (57) bore (7) and shows an explosive piston space provision system (10) member compression device (92) embodiment (10D). The member housing (96) is shown engagable to a jointed or coiled string of a rig or rig-less arrangement and contains an explosive that may be initiated by a firing head (98) to launch an piston (95) of an expandable type (95B), for example a bladder, diaphragm, or wad variety, which can be usable to compress the severed portion of the deployment conduit (56E, 56A, 56B), uncemented within a surrounding conduit (56A, 56B, 56C, respective to the severed deployment conduit). An orifice or one way-valve (97) can be usable to release trapped fluid below the piston (95B) compression device (92), of a jarring type (92A), as it moves within the containing conduit. The upper end of deployment conduit (56E, 56A, 56B) to be severed, may be anchored with a pinning arrangement (55) to allow the explosive to severe said conduit and move it axially downward relative to its anchored portion holding the member housing (96) and joint or coiled string deployment string. Alternatively, the deployment may be severed before being compressed axially downward to form debris (91).

FIG. 11 depicts left and right side diagrammatic plan above elevation cross section slices through a subterranean well (57) bore (7), and the Figure shows a space provision system (10) compression device (92) cable type (92B) embodiment (10E), before activation on the left side, and after activation on the right side. The compression device (92B) can be deployed via a cable (67) of a conduit buckling (99) type (67AD) and anchored (102) at its lower end, passing through a plurality of eccentric orifice (100) plates (101) that can be spaced within a compressible uncemented conduit within a containing conduit, wherein tensioning said cable can buckle said uncemented conduit by aligning the orifices (100) with the axis of the tension cable (67AD), thus allowing axial compression relative to the anchor of said buckled (99) conduit. Debris (91) can be formed by buckling and plastically deforming the conduit. A cable compression device (92B) may be combined with, for example, an explosive device (92A) of the present invention and/or axial compression and/or radial compression plug and/or diaphragm piston compression devices (92) or hydraulic jar and/or explosive compression devices (92) of the present inventor to further buckle and compress the buckled conduit.

Figure 4:
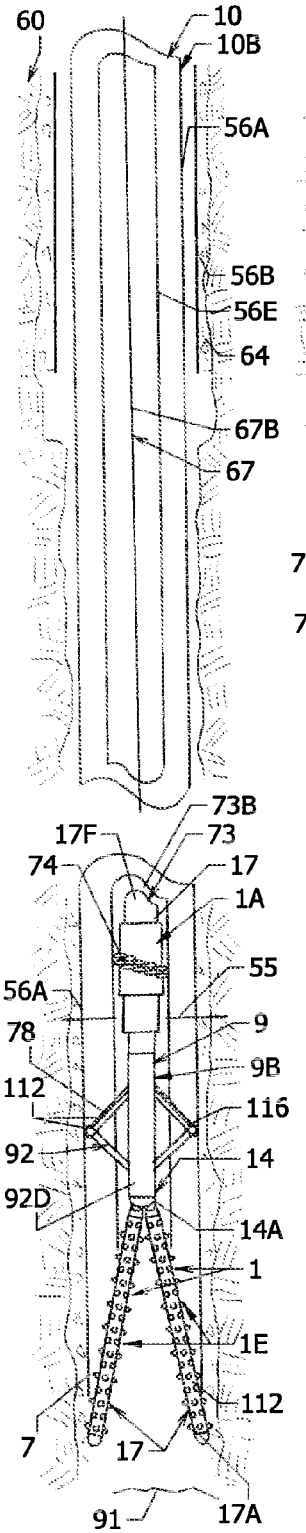
Figure 5:
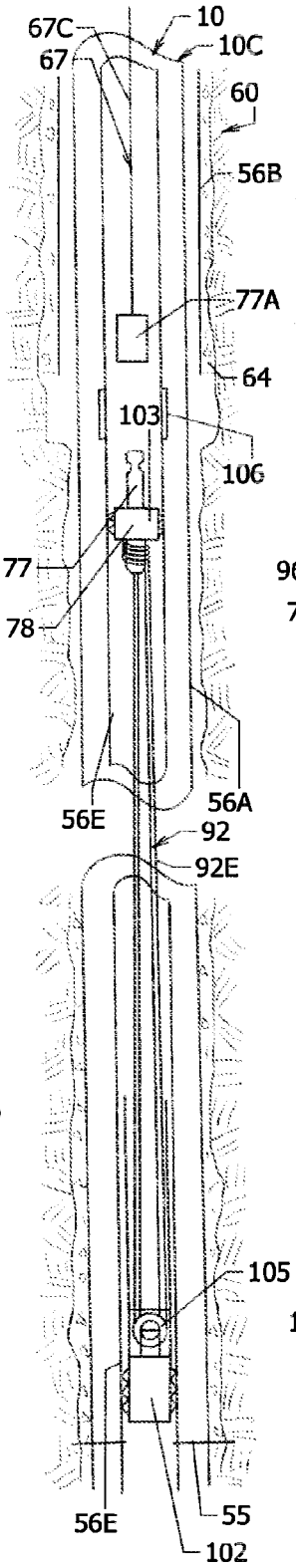
Figure 6:
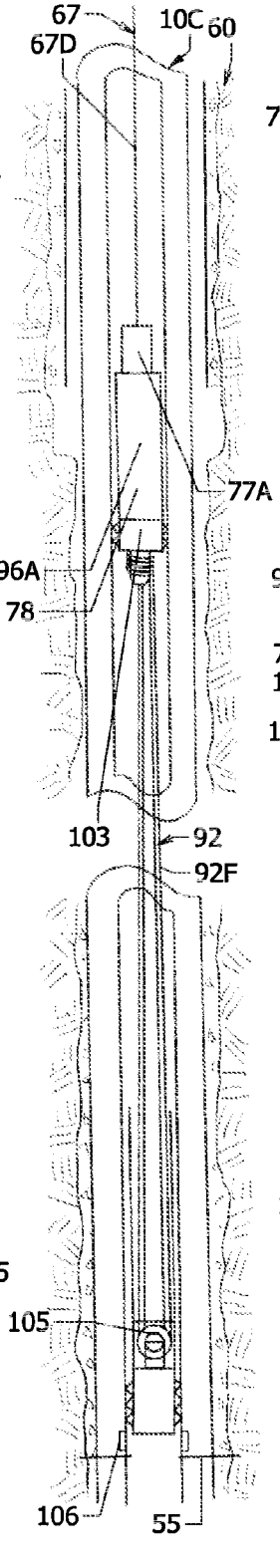
Figure 7:
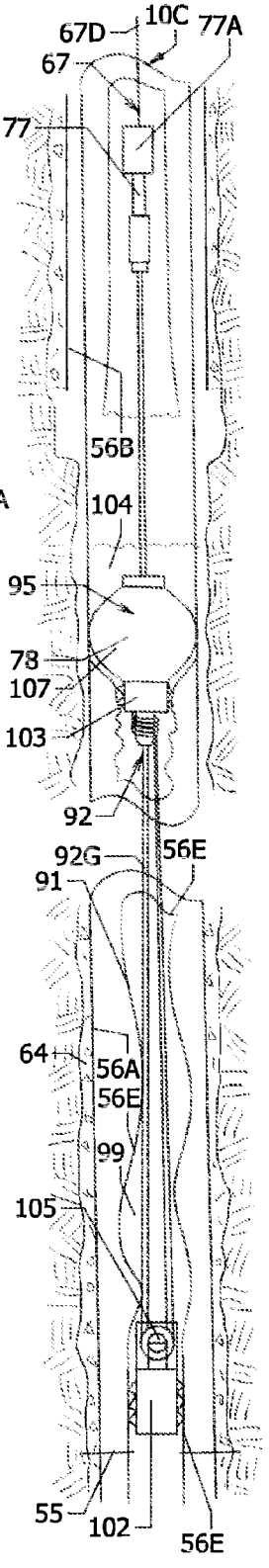

Referring now to FIGS. 4, 5, 6 and 7, showing a compression device (92) embodiment (92D) and directable hole opening boring string (9) embodiment (9B) in FIG. 4, with cable compressing device (92) embodiments (92E), (92F) and (92G) in FIGS. 5, 6 and 7, respectively.

FIG. 4, illustrates a diagrammatic elevation slice view through a well's bores and casings depicting a compression device (92) embodiment (92D) and hole opening boring (9) embodiment (9B), which can comprise a cable (67B) deployable piston string (73) embodiment (73B) using a reactive torque tractor (74), that can be operated with a motor (17F) to rotate the pendulum solid shafts of a milling motor (17) embodiment (17A) similar to the milling arrangement (9AA) of FIGS. 13 to 16. Tension of the cable (67B) and the tractor (74) provide upward movement in excess of the downward fluid pressure applied to the piston string (73B), wherein conduits may be pinned (55) in place to prevent adverse lateral movement and stabilizing arced walls (4), comprising elbowed screw extendable arms that may be radially extended to cut conduits with associated knife and/or wheeled cutting structures (112) on said arms to assist and stabilize said hole opening boring assembly (9) milling strata and/or casing. Debris (91) may be compressed into the lower end of said well by said milling of well apparatuses into smaller particles that may be compressed downward with pressure from above.

Referring now to FIG. 13, the Figure shows a diagrammatic elevation cross section slice view of a milling string (9AA of FIGS. 14 to 16) motor (17E) arrangement, which can pivotally deflect to engage successive larger bores (7) at ever increasing effective rotating diameters (23A) to mill conduits (56E, 56D, 56A, 57B, 56C), wherein the outer wall (5) has cutting surfaces (112) which also act as arched walls (4).

FIGS. 14, 15 and 16 illustrate a plan view with line E-E, an elevation cross section along line E-E, and an isometric section projection along line E-E, respectively, and show a fluid bearing (1) embodiment (1BM) with and outer wall (11AE) bearing sleeve (12AD) journal (69) bearing with an upper end pivotal (71) bearing, wherein fluid (23) enters (32) between profiles (3AB) and (6AG) to rotate the sleeve (12) about the shaft (2). Discharge orifices (33) are shown in FIG. 15. The forming of a motor (17) embodiment (17E) is achieved by using the fluid flow (23) through a passageway (22) within the pivotal bearing (71) to rotate the sleeve's outer wall (5) and associated arched surface (4), comprising a milling cutting structure (112) that can be usable to perform milling operations (9AA of FIG. 13). The sleeve (12) is illustrated to show the profiles (3AB) and (6AG), wherein, in practice, said sleeve extends to a sealable engagement at the pivot bearing (71).

Referring now to FIG. 5, a diagrammatic elevation slice view through a well's bores and casings is shown and the Figure depicts a compression device (92) embodiment (92E) that can be usable with a tensionable cable (67C) anchored (102, 103) at both ends, with a pulley (105) at the lower end. The conduit (56E) may be pinned (55) to the surrounding conduit (56A) and tension may be applied to a cable head (77) at the upper anchor (103) using a cable connector (77A) to, for example, engage the cable head, tension the associated cables, part a coupling (106), and buckle the deployment conduit (56E) below said parted coupling, using the lower end cable pulley (105) to tension the cable between the upper (103) and lower (102) anchors. Compression may occur either upward or downward depending on the arrangement of the pulley (105) at the upper or lower anchor, respectively, with associated pinning (55) and parting (55) or, for example explosive, chemical or mechanical cutting of the uncemented conduit (56E) being compressed within the surrounding conduits.

FIGS. 6 and 7 show diagrammatic elevation slice views through a well's bores and casings depicting compression device (92) embodiments (92F, 92G, respectively), which can be usable with a tensionable cable (67D) anchored (102, 103) at both ends with a pulley (105) at the lower end of a conduit, which is also shown pinned (105) to a surrounding conduit (56A). The cable's tension compression devices (92) for buckling (99) an well apparatus, e.g. the deployment conduit (56E) and any associated engaged apparatus or debris (91) using the tension of the cable (67D) between the anchors (102, 103) and pulley (105) to urge the buckled conduit and debris, formed by or engaged with said buckled conduit, within an uncemented space with tension applied to the cable head (77) and cable engagement (77A).

The compression device (92) of a cable and explosive type (92F), may comprise a housing (96A) about an explosive charge that, when fired, tensions the cable between the upper (103) and lower (102) anchors to part the lower cut or weakened conduit (106A) and compress the conduit (56A) axially upward, wherein the cable engagement (77A) may be disconnected and the deployment conduit (56E) above the compressed portion between the anchors may be cut, allowing the compressed debris to fall downward, or be pushed by a piston compressing device.

The compressing device (92) of a cable and piston type (92G), may comprise using and inflatable diaphragm type (107) piston (95) with debris and fluid (104), with a deployable diameter similar to the explosive housing (96A) shown, to radially burst and axially buckle (99) the deployment conduit (56E) between the anchors (102, 103) by pulling on the pulley (105) with cable engagement (77A) and cable head (77) with the cable (67D), thus applying buckling tension between said anchors.

Referring now to FIGS. 17 to 19 and 23-25, the Figures illustrate various boring arrangements for casing boring and placement with dual fluid gradient management pressure strings and chamber junctions of the present inventor, with a drilling rig (58A) or jointed pipe rig (58B), wherein small scale empirical testing may be carried out with, for example, jointed pipe rig-less arrangements (58B) or coiled tubing rigs (58C) using a coiled string (67F) with the present space provision system. After forming space with a compression device (92) and placing one or more abandonment plugs (89), empirical testing of a chamber junction's (119) bore selector (121) and access of an exit bore (120) can be carried out using a side-track (59C), wherein managed pressure slurry passageway tools (117, 118) with hydrodynamic bearings (1BP, 1BQ) can be tested, prior to using said technologies with a drilling rig (58A) or jointed pipe rig (58B) using jointed string. FIG. 19 shows a side-tracking and drilling assembly (9) embodiment (9C), which includes an in-line motor (17I) for rotating the cutting structure (112), Referring now to FIGS. 23 and 24, the Figures illustrate elevation views of managed pressure drilling upper (117) and lower (118) slurry passageway tools, with upper and lower rotary connections adaptable for piston pendulum arrangements (73) and inclusion of hydrodynamic bearings (1BP, 1BQ), wherein fluid circulation may occur through a plurality of passageways within the strings (67N) and (67O).

Referring now to FIG. 25, the Figure shows an isometric section view through the well and strata, depicting a chamber junction (119), from which exit bores (120) may be bored, wherein this new technology may be tested and/or proved in the upper end of a well abandoned at its lower end.

FIGS. 26 and 27 show a plan view with line F-F and a cross section elevation through line F-F, respectively, depicting a simultaneous flow chamber junction (122) usable as a dual conduit, for example (56E) and (56A), wherein the new technology may be tested in, for example, the multi-flow arrangement and bore selector and removable whipstock (128) of FIGS. 28 and 29 side-track (59D) using the present space provision system (10) embodiment (10F).

Referring now to FIGS. 28 and 29, the Figures depict a elevation cross section through the well and strata with line G and an associated magnified detail view within line G, respectively, showing a pendulum piston assembly (73) embodiment (73E) with a tractor (74) with hydrodynamic bearing (1, 1AF), comprising a motor (17, 17J) and bearings (1AG), comprising a fluid pump (18, 18F) with a pivotal hydrodynamic bearing (1AU) above a cutting structure (112), similar to FIG. 106 hydrodynamic bearing (1BL). The jointed conduit pendulum boring string (9, 9F) forms part of the piston (73E) driven by a motor (17, 17K) with a tractor (74), suspendable from a cable head (77). Axial force (16) is applied to the pendulum string (73E) by pump pressure force (73E) at the top of the cable deployable motor (17K). Reactive torque tractors (74) may also be modified with fluid bearing (1). FIG. 29 shows, in detail, a hydrodynamic bearing (1) that is disposed about a shaft (2), with at least one periphery arced wall (4, 4H) extending from a circumference of a conduit shaft housing (14D).

To facilitate the side-track (59) embodiment (59D) an abandonment plug (89) was placed after a space provision system (10) embodiment (10F) involving the compression of debris (91) to form a usable space for said plug (89) and side-track (59D) new technology (78) empirical testing.

While various embodiments of the present invention have been described with emphasis, it should be understood that within the scope of the appended claims, the present invention might be practiced other than as specifically described herein.

Reference numerals have been incorporated in the claims purely to assist understanding during prosecution.

The embodiments of the invention in which an exclusive property or privilege is claimed are defined follows:

1. A space provision system (10, 10A-10H) for forming a geologic testing space for proving an operation of at least one unproven downhole apparatus (78, 92) within an aged geology, during the rig-less abandonment of an aging well to, in use, reallocate operation of said at least one unproven downhole apparatus from unproven to proven operation within a proximally similarly aged geology of said aging well, another aging well (79), a new well (80), or a field of said wells (79, 80), said space provision system comprising:

said at least one unproven downhole apparatus comprising at least one hydrodynamic bearing boring apparatus (1A, 1E, 1BM, 9AA, 92D) or a bore hole piston apparatus (1A, 1AF, 92A-92C, 92E-92G), wherein said at least one unproven downhole apparatus comprises a rig-less bore hole opening member (92) that is driven in part by hydraulics, wherein said rig-less bore hole opening member is further drivable by an explosion, a cable, or combinations thereof, and is deployable through an upper end of said aging well, within one or more conduits having at least an inner bore hole within a wall of at least one concentric surrounding bore that is engagable by said rig-less bore hole opening member during abandonment of a lower end of said aging well, such that said rig-less bore hole opening member opens said inner bore hole axially along, and radially into, said wall of said at least one concentric surrounding bore, wherein debris (91) from said opening of said inner bore is disposed and compressed within said lower end of said aging well for placement of a settable pressure sealing material, wherein the settable pressure sealing material is placed axially above said debris and within said wall of said at least one concentric surrounding bore at said lower end of said aging well to provide a proximal geology above said settable pressure sealing material that is comparable to at least one portion of a geology of said aging well, a geology of said another aging well, a geology of said new well or a geology of said field of wells to form, in use, said geologic testing space, wherein said geologic testing space is usable to empirically measure operating parameters of said at least one unproven downhole apparatus (78, 92), and wherein said geologic testing space comprises said at least one unproven down hole apparatus (78) to provide empirical data for adapting or proving said at least one unproven downhole apparatus to, in use, reallocate operation of said at least one unproven downhole apparatus from unproven to proven operation within said geologic testing space for use within a similar geologic environment of said aging well, said another aging well, said new well, or said field of said wells.

2. The space provision system according to claim 1, wherein said rig-less bore hole opening member (92) comprises a rig-less cutting apparatus to disengage said debris (91) from engagements that prevent disposal and compression of said debris within said lower end of said aging well.

3. The space provision system according to claim 2, wherein said rig-less bore hole opening member (92, 1A, 1E, 1BM, 92D) comprises at least one hydrodynamic bearing (1) that is disposed about a shaft (2) and an outer wall (5) of a cutting structure (112) and positioned within said wall of said concentric surrounding bore (7), with at least one periphery arced wall (4) radially extending from, and arranged about, a circumference of a conduit shaft housing (14) and about at least one inner wall (6) that is adjacent to at least one associated hydrodynamic profiled wall (3), wherein said rig-less bore hole opening member is rotatable by or about said shaft to displace fluid axially along said at least one inner wall that is anchored by combined frictional engagements of said fluid, said at least one associated hydrodynamic profiled wall (3), said at least one inner wall (6), said at least one periphery arced wall (4), and said wall of said at least one concentric surrounding bore (7) to force said fluid between an adjacent set of at least two of said walls, wherein said displacing of fluids forms a pressurized (8) cushion that is fluidly communicated to and from said set of at least two walls to, in use, operate said cutting structures (112) to form said debris (91), while lubricating and dampening associated rotational shocks and vibrations with a shearing of said frictional engagements when bearing said shaft, during rotation of said cutting structures within said wall of said at least one concentric surrounding bore.

4. The space provision system according to claim 1, wherein said rig-less bore hole opening member (92) comprises a plug, a diaphragm, or combinations thereof, and wherein said rig-less bore hole opening member (92) is placed adjacent to said debris (91) for said disposal and compression of said debris within said lower end of said aging well by using differential fluid pressure across said bore hole piston apparatus, wherein fluid is injected into said one or more conduits to form a high pressure region at a first side of said bore hole piston apparatus and a lower pressure region at a second side of said bore hole piston apparatus to operate said rig-less bore hole opening member axially along and radially into said wall of said at least one concentric surrounding bore.

5. The space provision system according to claim 4, wherein said rig-less bore hole opening member (92) comprises a hydraulic jar, an explosive, or combinations thereof, for urging the disposal and compression of said debris (91) within said lower end of said aging well.

6. The space provision system according to claim 5, wherein said rig-less bore hole opening member (92) comprises a firing gun (92A) placeable by deployment string for explosively firing a piston (95) from a housing (96), wherein said piston is adaptable with an orifice, valve, or combinations thereof, to relieve trapped pressure from beneath said piston when fired.

7. The space provision system according to claim 1, wherein said rig-less bore hole opening member (92) comprises a cable tension compression device (92B, 92E, 92F, 92G) for buckling (99) said one or more conduits to form said debris (91) by using a tensionable cable (67) that is anchored (102, 103) with a pulley (105) at one or more ends thereof to axially compress said debris relative to said pulley.

8. The space provision system according to claim 7, wherein said cable passes through at least one eccentric orifice (100) of a plurality of plates (101) that are spaced within said one or more conduits, and wherein tensioning cable alignments of said eccentric orifices urges the plurality of plates radially into said inner bore to buckle (99) said one or more conduits axially along, and radially into, said wall of said at least one concentric surrounding bore to form said debris.

9. The space provision system according to claim 1, wherein said rig-less bore hole opening member (92) compresses said debris axially along or radially into said wall of said at least one concentric surrounding bore.

10. The space provision system according to claim 1, further comprising a logging tool apparatus having a transponder, receiver, or combinations thereof, wherein the logging tool apparatus is placed in said rig-less bore hole opening member (92), said downhole apparatus (78), a wellhead, said geologic testing space, said settable pressure sealing material, or combinations thereof, and wherein said transponder or receiver is placeable within a shock and compression resistant enclosure to send signals through fluids or casings of said aging well.

11. The space provision system according to claim 10, wherein said logging tool apparatus empirically measures (93) said operating parameters of said at least one unproven downhole apparatus to form at least one measurement comprising tolerances, rotary speeds, shocks, vibrations, stick-slip, whirl, harmonic resonances, or combinations thereof, for operation of said at least one unproven downhole apparatus (78) within subterranean substances, pressures and temperatures of said aged geology.

12. The space provision system according to claim 10, wherein said logging tool apparatus empirically measures (93) and provides associated empirical data of subterranean strata geologic periods and epochs that is similar to said another aging well, said new well or said fields of said wells.

13. The space provision system according to claim 1, further comprising production infrastructure for hydraulically operating said rig-less bore hole opening member (92) and for fluidly accessing said aging well through said one or more conduits.

14. The space provision system according to claim 13, wherein said production infrastructure is usable to extract production from a subterranean resource.

15. The space provision system according to claim 1, wherein said aging well is side-tracked using said rig-less bore hole opening member (92) or said at least one unproven downhole apparatus (78).

16. The space provision system according to claim 1, wherein said at least one unproven downhole apparatus (78) is proven deployable and operable within said one or more conduits and said geologic testing space, that is provided by said rig-less bore hole opening member (92), for proven use across a plurality of proximally similar geologic environments of said another aging well (79), said new well (80), said field of said wells (79, 80) or combinations thereof.

17. A method (10, 10A-10H) for forming a geologic testing space to prove an operation of an unproven downhole apparatus (78, 92) within an aged geology during a rig-less abandonment of an aging well to, in use, reallocate operation of said unproven downhole apparatus, from unproven to proven operation, within a proximally similarly aged geology of said aging well, another aging well (79), a new well (80), or a field of said wells (79, 80), said method comprising the steps of:

measuring (93) empirically an operating parameter of an unproven downhole apparatus comprising at least one hydrodynamic bearing boring apparatus (1A, 1E, 1BM, 9AA, 92D) or a bore hole piston apparatus (1A, 1AF, 92A-92C, 92E-92G), wherein said unproven downhole apparatus comprises a rig-less bore hole opening member (92) that is driven in part by hydraulics, and further by an explosion, a cable, or combinations thereof;

deploying said rig-less bore hole opening member through an upper end of said aging well, within one or more conduits having at least an inner bore hole within a wall of at least one concentric surrounding bore that is engagable by said rig-less bore hole opening member during the abandonment of a lower end of said aging well;

using said rig-less bore hole opening member for opening said inner bore hole axially along and radially into said wall of said at least one concentric surrounding bore, wherein debris (91) from said opening of said inner bore is disposed and compressed within said lower end of said aging well;

placing a settable pressure sealing material axially above said debris and within said wall of said at least one concentric surrounding bore at said lower end of said aging well to provide a proximal geology above said settable pressure sealing material that is comparable to at least one portion of a geology of said aging well, a geology of said another aging well, a geology of said new well, or a geology of said field of said wells to form, in use, said geologic testing space; and using said geologic testing space to empirically measure said operating parameters of said unproven downhole apparatus (78, 92) to provide empirical data for adapting or proving said unproven downhole apparatus to, in use, reallocate operation of said unproven downhole apparatus, from unproven to proven operation, within said geologic testing space for use within a similar geologic environment of said aging well, said another aging well, said new well, or said field of said wells.

18. The method according to claim 17, further comprising the steps of providing said rig-less bore hole opening member (92) with a rig-less cutting apparatus and using said rig-less cutting apparatus to disengage said debris (91) from engagements that prevent disposal and compression of said debris within said lower end of said aging well.

19. The method according to claim 18, further comprising the steps of:

providing said rig-less bore hole opening member (92, 1A, 1E, 1BM, 92D) with at least one hydrodynamic bearing (1) disposed about a shaft (2) and an outer wall (5) cutting structure (112) positioned within said wall of said at least one concentric surrounding bore (7), with at least one periphery arced wall (4) radially extending from and arranged about the circumference of a conduit shaft housing (14) and about at least one inner wall (6) that is adjacent to at least one associated hydrodynamic profiled wall (3) rotatable by or about said shaft; and displacing fluid axially along said at least one inner wall that is anchored by the combined frictional engagements of said fluid, said at least one associated hydrodynamic profiled wall (3), said at least one inner wall (6), said at least one periphery arced wall (4) and said wall of said at least one surrounding concentric bore (7) to force said fluid between an adjacent set of at least two of said walls, wherein said displacing of fluids forms a pressurized (8) cushion that is fluidly communicated to and from said set of at least two walls to, in use, operate said cutting structures (112) to form said debris (91), while lubricating and dampening associated rotational shocks and vibrations with a shearing of said frictional engagements when bearing said shaft during rotation of said cutting structures within said wall of said at least one concentric surrounding bore.

20. The method according to claim 17, further comprising the steps of providing said rig-less bore hole opening member with a plug, a diaphragm, or combinations thereof; placing said rig-less bore hole opening member (92) adjacent to said debris (91) for said disposal and compression of said debris within said lower end of said aging well by using differential fluid pressure across said bore hole piston apparatus; and injecting fluid into said one or more conduits to form a high pressure region at a first side of said borehole piston apparatus and a lower pressure region at a second side of said borehole piston apparatus to operate said rig-less bore hole opening member axially along and radially into said wall of said at least one concentric surrounding bore.

21. The method according to claim 17, further comprising the step of providing said rig-less bore hole opening member with a hydraulic jar, an explosive, or combinations thereof, for urging the disposal and compression of said debris (91) within said lower end of said aging well.

22. The method according to claim 21, further comprising the steps of providing said rig-less bore hole opening member with a firing gun (92A) placeable by deployment string; and explosively firing a piston (95) from a housing (96) using an explosion, wherein said piston is adaptable with an orifice, valve, or combinations thereof, to relieve trapped pressure from beneath said piston when fired.

23. The method according to claim 17, further comprising the step of providing said rig-less bore hole opening member (92) with a cable tension compression device (92B, 92E 92F, 92G) for buckling (99) said one or more conduits to form said debris (91) by using a tensionable cable (67) that is anchored (102, 103) with a pulley (105) at one or more ends thereof to axially compress said debris relative to said pulley.

24. The method according to claim 23, further comprising the steps of passing said cable through at least one eccentric orifice (100) of a plurality of plates (101), that are spaced within said one or more conduits; and tensioning said cable to urge the plurality of plates radially into said inner bore to buckle (99) said one or more conduits axially along, and radially into, said wall of said at least one concentric surrounding bore to form said debris.

25. The method according to claim 17, further comprising the step of using said rig-less bore hole opening member (92) to compress said debris axially along or radially into said wall of said at least one concentric surrounding bore.

26. The method according to claim 17, further comprising the step of placing a logging tool apparatus having a transponder, receiver, or combinations thereof, in said rig-less bore hole opening member (92), said downhole apparatus (78), a wellhead, said geologic testing space, said settable pressure sealing material, or combinations thereof, wherein said transponder or receiver is placeable within a shock and compression resistant enclosure to send signals through fluids or casings of said aging well.

27. The method according to claim 26, further comprising the step of using said logging tool apparatus for empirically measuring (93) said operating parameters of said unproven downhole apparatus for forming at least one measurement comprising tolerances, rotary speeds, shocks, vibrations, stick-slip, whirl, harmonic resonances, or combinations thereof, for operation of said unproven down hole apparatus within subterranean substances, pressures and temperatures of said aged geology.

28. The method according to claim 26, further comprising the step of using said logging tool apparatus to provide empirical measurements (93) and associated empirical data of subterranean strata geologic periods and epochs that is similar to said another aging well, said new well, or said fields of said wells.

29. The method according to claim 17, further comprising the step of using production infrastructure for hydraulically operating said rig-less bore hole opening member (92) and for fluidly accessing said aging well through said one or more conduits.

30. The method according to claim 29, further comprising the step of using said production infrastructure to extract production from a subterranean resource.

31. The method according to claim 17, further comprising the step of side-tracking said aging well to a subterranean resource using said rig-less bore hole opening member (92) or said unproven downhole apparatus (78).

32. The method according to claim 17, comprising the step of proving said unproven downhole apparatus (78) within said geologic testing space, that is provided by said rig-less bore hole opening member (92), for proven use across a plurality of proximally similar geologic environments of said another aging well (79), said new well (80), or said field of said wells (79, 80).

* * * * *